US006385420B1

(12) United States Patent
Morioka

(10) Patent No.: US 6,385,420 B1
(45) Date of Patent: May 7, 2002

(54) CHARGING APPARATUS FOR CONTACTING AND SEPARATING CHARGING MEMBER BY USE OF MOVING FORCE OF BODY TO BE CHARGED

(75) Inventor: Masanari Morioka, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/676,948

(22) Filed: Oct. 2, 2000

(30) Foreign Application Priority Data

Oct. 6, 1999 (JP) ..... 11-286027
Oct. 14, 1999 (JP) ..... 11-292645
Oct. 14, 1999 (JP) ..... 11-292654

(51) Int. Cl.[7] ..... G03G 15/02; G03G 21/00
(52) U.S. Cl. ..... 399/174; 399/115; 399/176
(58) Field of Search ..... 399/167, 111, 399/115, 116, 117, 174, 175, 176, 50

(56) References Cited

U.S. PATENT DOCUMENTS 5,666,608 A * 9/1997 Christensen ..... 339/176

* cited by examiner

*Primary Examiner*—Arthur T. Grimley
*Assistant Examiner*—Hoang Ngo
(74) *Attorney, Agent, or Firm*—Fitzpatrick, Cella, Harper & Scinto

(57) ABSTRACT

A charging apparatus charges a moving body to be charged, which has a charging member for coming in contact with the body to be charged to charge the body to be charged, and contacting/separating device for contacting the charging member with and separating the charging member from the body to be charged, wherein the contacting/separating device converts a moving force of the body to be charged into a force for contacting/separating the charging member.

38 Claims, 40 Drawing Sheets

CHARGING APPARATUS FOR CONTACTING AND SEPARATING CHARGING MEMBER BY USE OF MOVING FORCE OF BODY TO BE CHARGED

BACKGROUND OF THE INVENTION

1. Field of the Invention

The present invention relates to a charging apparatus used in a copy machine, a printer and other image forming apparatuses employing an electrophotographic method or a static recording method.

2. Related Background Art

A transfer type electrophotographic apparatus has typically the following means configuration and image forming processes. That is, the apparatus typically comes in such a type that uses a rotating drum as its image bearing body and comprises the steps of: using an electrophotographic photosensitive body made of such a substance as selenium, cadmium sulfide, zinc oxide, amorphous silicon, or an organic photoconductive substance to uniformly charge a surface of that photosensitive body to a predetermined potential by use of charging means; image-exposing the charged photosensitive body by image-exposure means to form a corresponding electrostatic latent image; sticking toner of a developer to that electrostatic latent image by developing means to develop as a toner image; transferring that toner image onto at transfer material; and fixing that toner image using fixing means and then discharge it as an image formed medium (copy or print). In this process, the rotating photosensitive body after the toner image is transferred onto the material to be transferred is removed the transfer material toner by cleaning means (cleaner) and used in image formation repeatedly.

As for a process cartridge capable of detachably attaching to the main body of the printer or the copy machine these process means, i.e. the charging means, the developing means, and the cleaning means as well as the electrophotographic photosensitive body, many such types are known and put to practical use that in the initial settings, members abutting against the electrophotographic photosensitive body and its surrounding process means, especially the former, remain as abutting against that. Furthermore, other such types are known that to prevent nicking by vibration or drop, a protecting member is placed between the electrophotographic photosensitive body and the other abutting members, to activate and deactivate the abutting in a manner interlocked with an operation of attaching detaching of the process cartridge to the printer main body.

In the above-mentioned prior art example, however, the electrophotographic body, especially the photosensitive drum made of an organic photosensitive body is continuously abutted by such members as the cleaning member, the contact charging member, and the developing member, which may give rise to the following variety of problems if they are left or stored unused.

A cleaning blade, having an edge portion, of the above-mentioned cleaning member has a concentrated pressure applied at that edge portion, which produces irregularities in a surface of the photosensitive drum abutting against that edge portion, which irregularities in turn produce undesired stripes in an image when it is created both in normal developing and reversal developing.

Furthermore, a cleaning blade made of rubber etc. of the cleaning member gives the photosensitive drum an abutting force changing with its own deviation and deformation, to have permanent deformation of its own and hence a reduced abutting force, thus being disabled to remove the residual toner etc. on the photosensitive drum and contributing to image contamination.

A roller and a blade of the above-mentioned contact charging member may also have compressive deformation or permanent deformation due to their own abutting, thus giving rise to non-uniform charging or poor imaging.

Moreover, a contact type developing sleeve of the above-mentioned developing member may have compressive deformation at its own abutting nip portion, to have poor toner coating or deviated abutting at the developing portion, thus producing an uneven abutting portion pitch on an image.

To prevent these, for example, even with such a type of the process cartridge to which various process means are attached and detached corresponding to the attachment and detachment of the process cartridge main body, these process means can be exempted from being abutted from a time when it is manufactured to a time when it is used by a user, after which however, no measures can be taken for a long nonuse period, so that the material of these process means must be selected from those not liable to be deformed with difficulty.

Furthermore, such a type of the process cartridge does not suffer from the above-mentioned poor imaging due to neglecting that employs a mechanism of butting the process means only when an image is being formed according to a method of attaching and detaching the photosensitive drum using a solenoid clutch or a method of rotating the photosensitive drum in a direction reverse to that for forming images in order to move the process means. The solenoid clutch and other electric components, however, may bring about higher costs of the apparatus and, the reversal rotation of the photosensitive drum may not permit the cleaning means to remove the residual toner which is in contact with the photosensitive drum.

Moreover, a rotating portion of the developing device for always supplying an appropriate amount of toner to the photosensitive drum is typically synchronized with it in rotation, so that when it is rotated in a reverse direction, the toner may be discharged more than necessary and scattered. A one-way clutch would lead to higher costs, if mounted to guard against this in an attempt to rotate that rotating portion in synchronization only with the image forming rotation of the photosensitive drum.

SUMMARY OF THE INVENTION

It is an object of the invention to provide a charging apparatus capable of touching a charging member to and separating it from a body to be charged.

It is another object of the invention to provide a process cartridge capable of contacting a process member with and separating it from a photosensitive body.

It is a further another object of the invention to provide a charging apparatus comprising:

a charging member for coming in contact with the body to be charged to charge the body to be charged; and contacting/separating means for contacting the charging member with and separating the charging member from the body to be charged, wherein the contacting/separating means converts a moving force of the body to be charged into a force for contacting/separating the charging member.

It is a further another object of the invention to provide a process cartridge comprising:

a photosensitive body;

a process member, pressure-contacting with the photosensitive body, for acting on the photosensitive body; and contacting/separating means for contacting the process member with and separating the process member from the photosensitive body;

wherein the contacting/separating means converts a moving force of the photosensitive body into a force for contacting/separating the process member.

The other objects of the invention may be clear upon reading of the following description.

BRIEF DESCRIPTION OF THE DRAWINGS

FIGS. 33A and 33B show meshing between a cut-tooth (untoothed) gear, drum gear, and the like;

DESCRIPTION OF THE PREFERRED EMBODIMENTS

The following will describe embodiments of the invention with reference to the drawings.

FIGS. 1 through 13 show a first embodiment of the invention.

Figure 1:
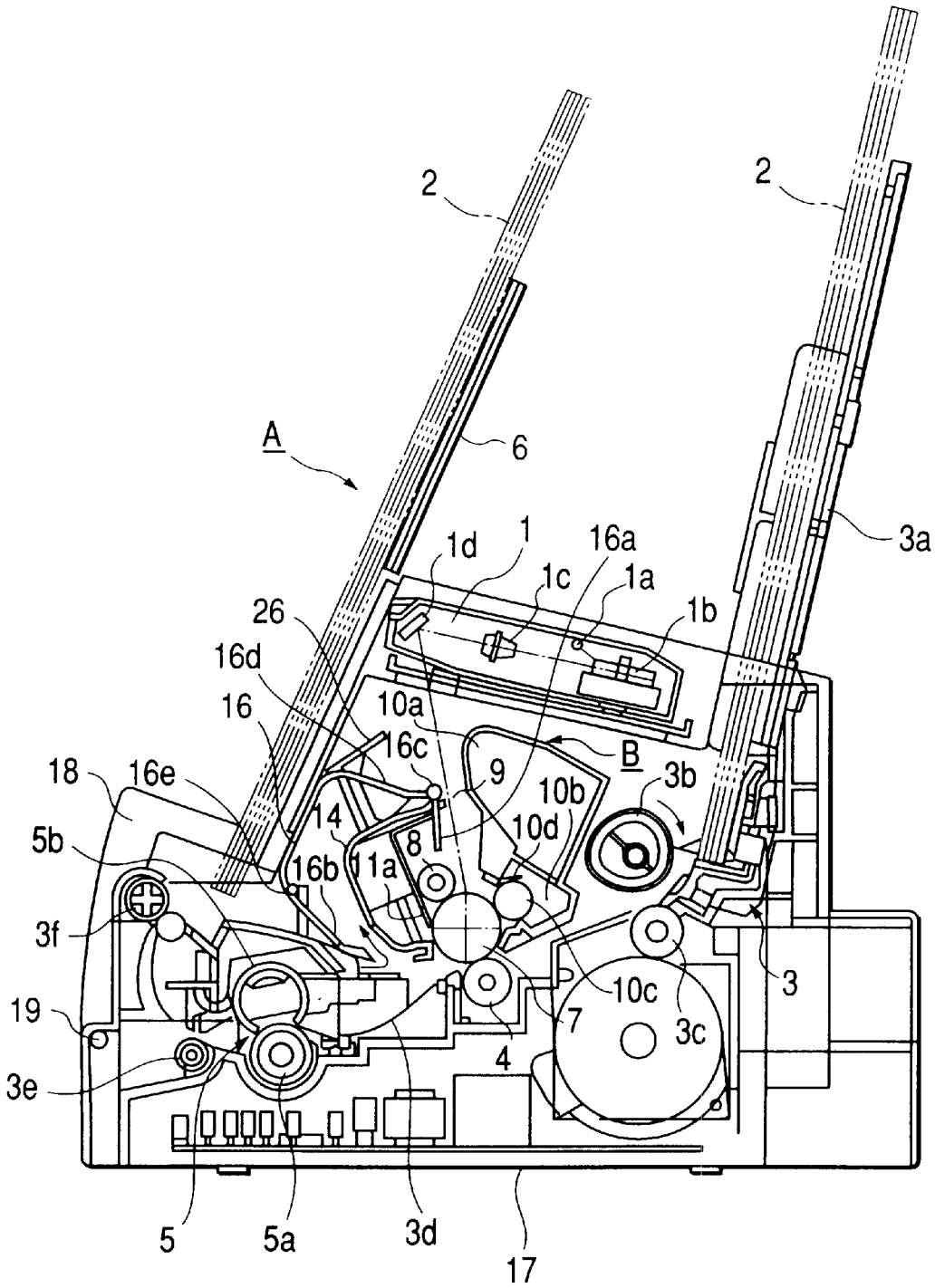
FIG. 1 is a vertical cross-sectional view showing an image forming apparatus as mounted with a process cartridge according to a first embodiment of the invention.
Figure 2:
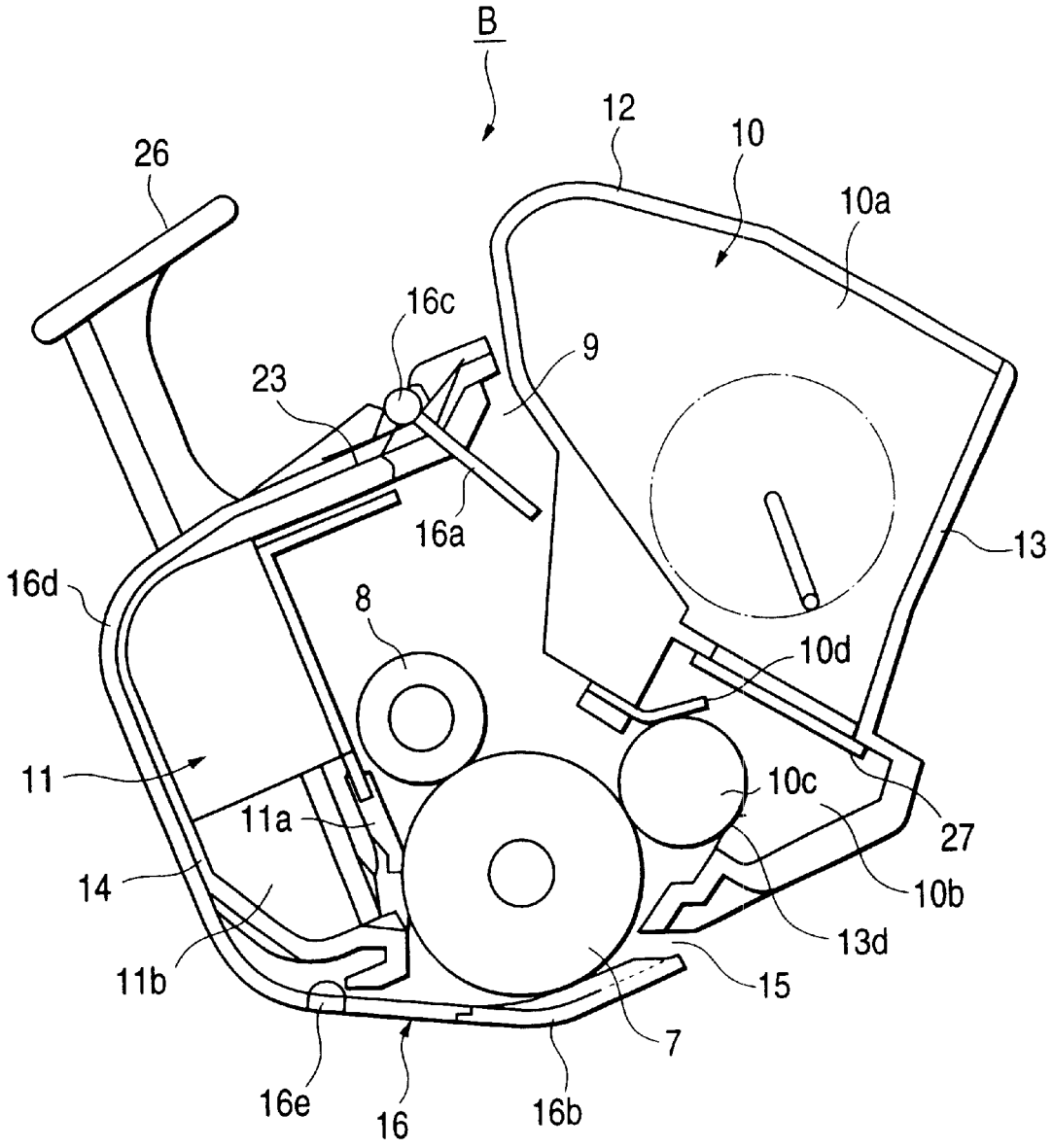
FIG. 2 is a vertical cross-sectional view of the process cartridge of FIG. 1.
Figure 3:
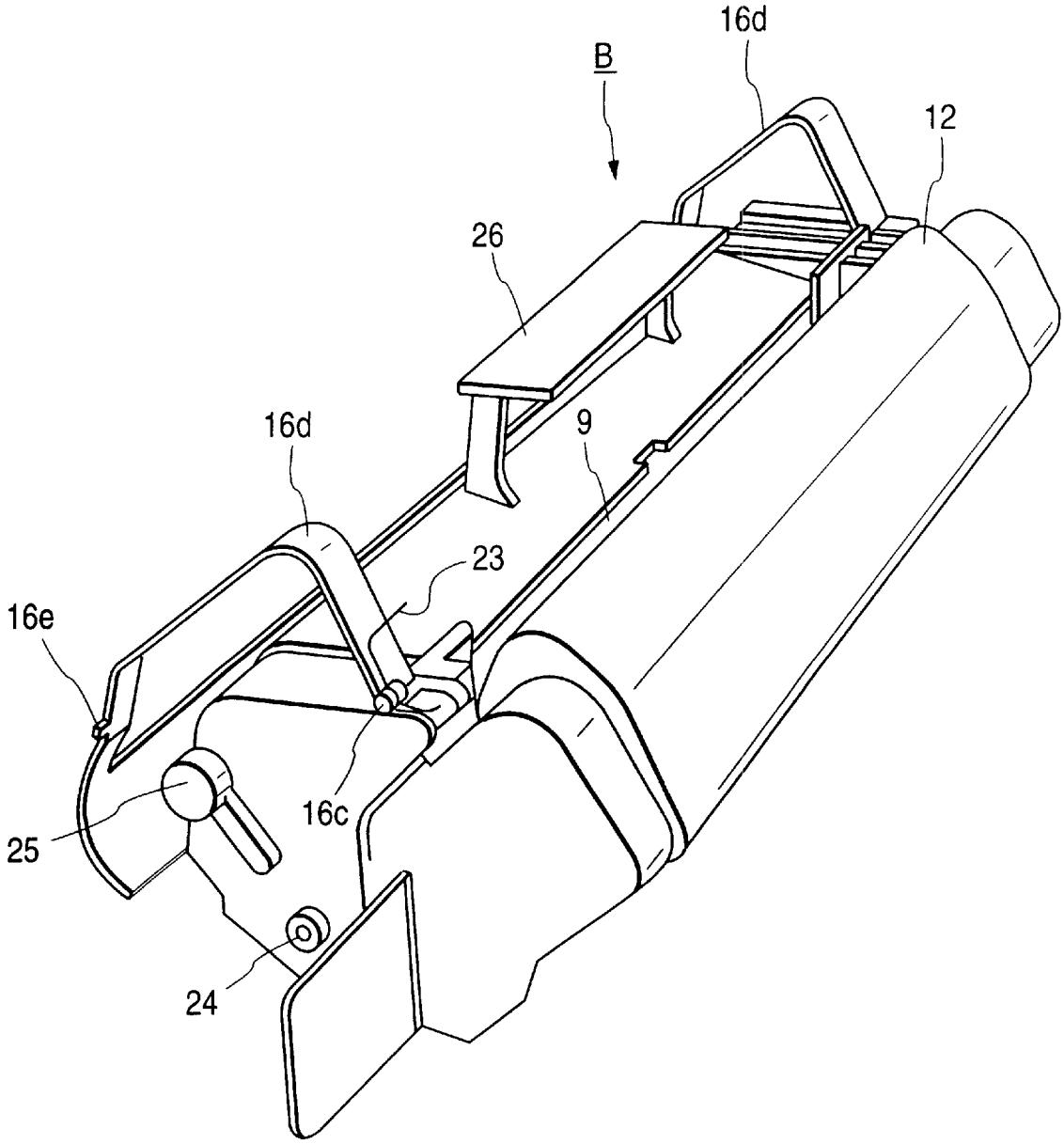
FIG. 3 is an external perspective view of the process cartridge of FIG. 2.
Figure 4:
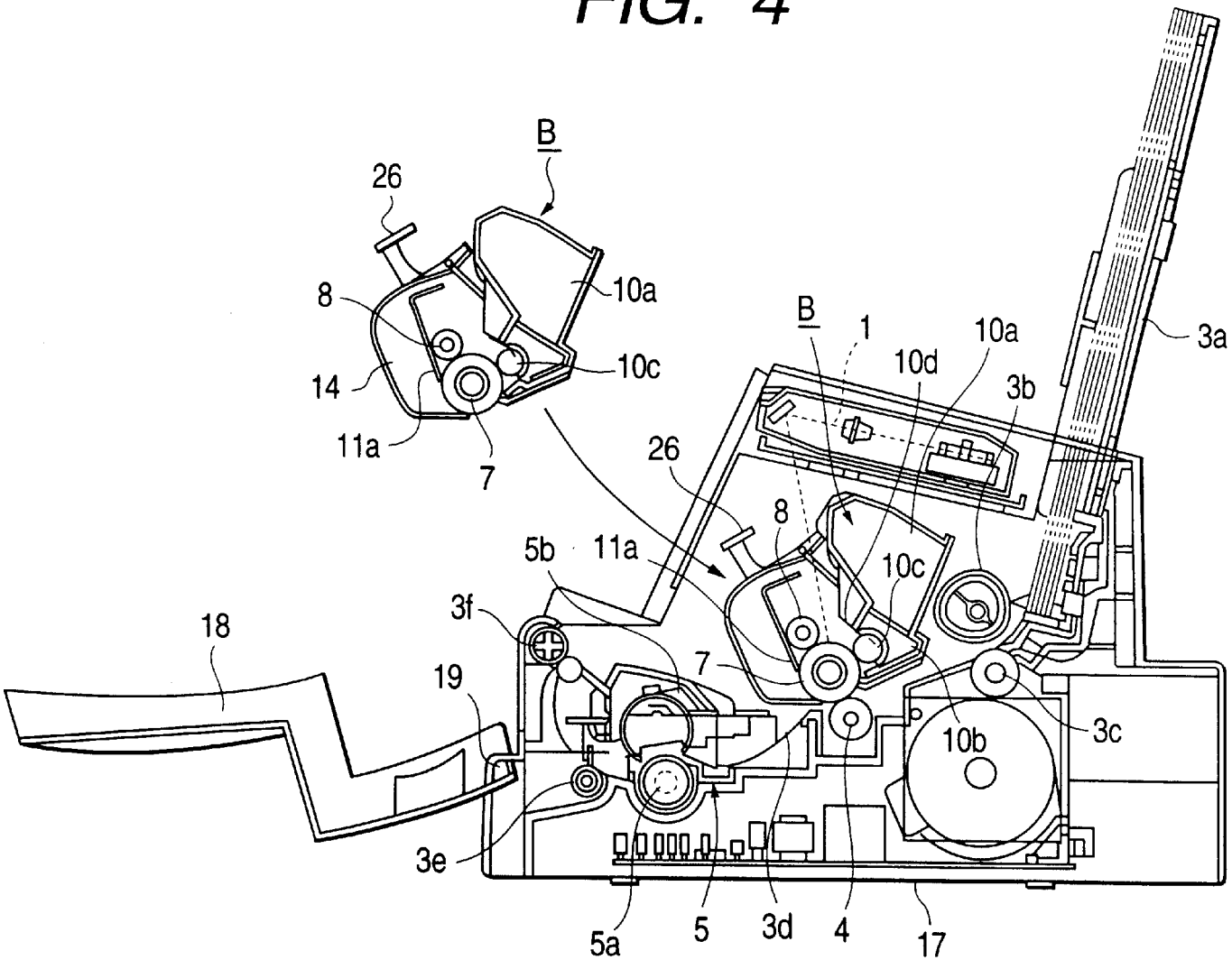
FIG. 4 shows a state where the process cartridge is mounted through the opened switching cover of the image forming apparatus of FIG. 1.

The following will describe an electrophotographic image forming apparatus and a process cartridge of the invention with FIGS. 1 through 4. FIG. 1 shows an overall configuration of the electrophotographic image forming apparatus mounted with the process cartridge, FIGS. 2 and 3 show a configuration of the process cartridge, FIG. 4 shows a state where an open/close cover is opened, through which the process cartridge is mounted to the main body of the apparatus.

As shown in FIG. 1, the electrophotographic image forming apparatus A of this embodiment acts to form an image onto a recording medium 2 by use of an electrophotographic image forming process, specifically a tone image onto an image-bearing, drum-shaped electrophotographic body (hereinafter called photosensitive drum) 7. Then, in synchronization with the formation of the toner image, the recording medium set on a conveying tray 3*a* is conveyed by conveying means 3 comprising a pick-up roller 3 and a conveying roller 3*c*.

Then, the toner image formed on the photosensitive drum 7 of a process cartridge B is transferred to the recording medium 2 by applying a voltage to a transferring roller 4 which serves as transferring means. Then, the recording medium having the toner image thereon is conveyed to fixing means 5 using a guide 3*d*. This fixing means 5 comprises a driving roller 5*a* and a fixing rotating body 5*b* with a built-in heater, to fix the transferred toner to the recording medium 2 passing therethrough, by applying heat and pressure thereon. Then, this recording medium 2 is turned over in conveyance with sheet discharging rollers 3*e* and 3*f* to be discharged to a discharging tray.

The process cartridge B, on the other hand, rotates as shown in FIGS. 1 and 2 the photosensitive drum 7 having a photosensitive layer as the image bearer, to uniformly charge its surface by applying a voltage to a charging roller serving as charging means. Then, laser beam corresponding to image information from an optical system 1 is applied to the photosensitive drum 7 via an exposing aperture 9, to form a latent image. This latent image is in turn developed by developing means 10 using toner. That is, the charging roller 8 is provided in contact with the photosensitive drum 7, thus charging it. The developing means 10, on the other hand, supplies toner to a developing region of the photosensitive drum 7, to develop the latent image formed on the photosensitive drum 7. Note here that the optical system 1 has a laser diode 1*a*, a polygon mirror 1*b*, a lens 1*c*, and a reflecting mirror 1*d*.

The developing means 10 supplied the toner contained in a toner chamber 10*a* to a developing chamber 10*b*, to rotate a developing roller 10*c* mounted to the developing chamber 10*b* and also form a toner layer provided with frictional charge by a developing blade 10*d* onto a surface of the developing roller 10*c* having a built-in fixed magnet, thus supplying the toner to the developing region of the photosensitive drum 7. Then, that toner is shifted to the photosensitive drum 7 according to the latent image, thus forming and visualizing a toner image.

Then, by applying a voltage opposite in magnetism to the toner image to the transferring roller 4, the toner image formed on the photosensitive drum 7 is transferred to the recording medium 2, to subsequently remove residual toner on the photosensitive drum 7 by use of cleaning medium 11. The cleaning medium 11 specifically uses an elastic cleaning blade 11*a* to scrape off the residual toner left on the photosensitive drum 7 and collect it in a removed-toner reservoir 11*b*.

Components of the photosensitive drum 7 etc. are integrated into a cartridge, i.e. a main body of a cartridge frame comprising a toner developing frame body, a toner developing wall member 13, and a cleaning frame body 14. That is, the toner developing frame body 12 and the toner developing wall member 13 are welded together to make up the toner chamber 10*a* and the developing chamber 10*b*, which is mounted with the developing roller 10*c* and the developing blade 10*d*. To the cleaning frame body 14 also are attached various members making up the photosensitive drum 7, the charging roller 8, and the cleaning means 11. Furthermore, the toner developing frame body 12 and the cleaning frame body 14 are coupled together in a rocking manner, to make up the process cartridge B.

This process cartridge B has therein the exposing aperture 9 for irradiating the photosensitive drum 7 with a light corresponding to image information as well as a transferring aperture 15 for counter-opposing of the photosensitive drum 7 against the recording medium 2. A shutter member 16 is provided which capable of opening and closing both apertures 9 and 15. That is, the transferring aperture 15 is used to transfer a toner image formed on the photosensitive drum 7 to the recording medium 2.

The image forming apparatus A, as shown in FIG. 4, is mounted to the main body 17 of the apparatus in such a manner that the switching cover 18 may be rotated around an axis 19 as a center. Through the open/close cover 18 opened, there is seen inside the apparatus main body 17 a guide member (rail groove), not shown, for guiding the process cartridge. With this, the operator can attach and detach the process cartridge B along the guide member. In this case, as shown in FIG. 3, a first protrusion 24 and a second protrusion 25 formed on a longitudinal end wall of the process cartridge B are guided along a guide member (not shown) of the above-mentioned apparatus main body 17.

As shown in FIGS. 2 and 3, the shutter member 16 has a second shutter portion 16*e* supported by a first shutter portion 16*a* and an arm portion 16*d* fixed respectively to a rotary supporting portion 16*c* supported in a rotary manner, so that a spring force of a twisted coil spring 23 mounted to a rotary supporting portion 16*c* is utilized to close the exposing aperture 9 in order to energize a second shutter portion 16*b* to close the transferring aperture 15, whereby when the process cartridge is outside the apparatus main body 17, the first shutter portion 16*a* and the second shutter portion 16*b* close the exposing aperture 9 and the transferring aperture 15 respectively.

When the process cartridge B is integrally mounted to the cleaning flame body 14 by use of a handle member 26, a stopping protrusion 16*e* longitudinally protruding outward from a top of the arm portion 16*d* supporting the second shutter portion 16*b* covering the photosensitive drum 7 abuts against the apparatus main body, so that the process cartridge B proceeds, as stopped from further entering the cartridge mounting portion, has the first and second protrusions 24 and 25 going forward along the guide member of the apparatus main body 17, thus causing the shutter member 16 to come to such a position as to open the exposing aperture 9 and the transferring aperture 15, as shown in FIG. 3. When the process cartridge B is taken out of the apparatus main body 17, on the other hand, the twisted coil spring 23 exerts its spring force to cause the shutter member 16 to close the exposing aperture 9 and the transferring aperture 15.

Figure 5:
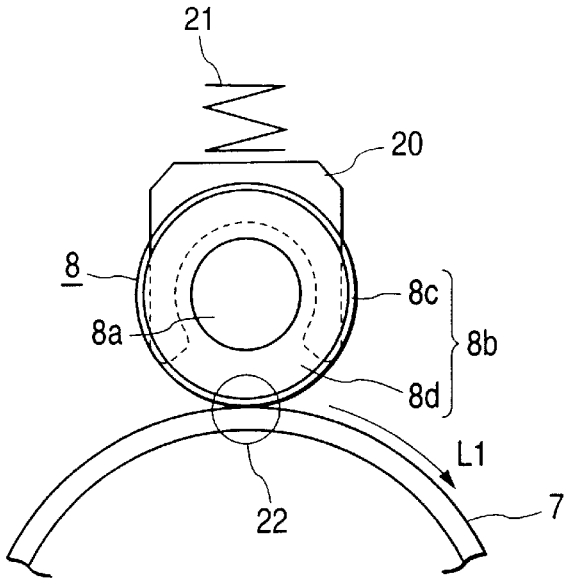
FIG. 5 is a cross-sectional view showing a charging roller of the process cartridge of FIG. 2.

Now the charging roller is described with reference to FIG. 5.

The charging roller 8 comprises, in configuration, a core metal (conductive substrate) 8*a* made mainly of SUS and a resistor layer 8*b* surrounding the core metal. The resistor layer 8*b* has a coating layer 8*c* serving as a surface layer and an underlying elastic layer 8*d*. The charging roller 8 is abutted via a bearing 20 made of a conductive layer member against the photosensitive drum 7 by such an energizing member 21 as a coil spring, thus configuring an electric circuit. Furthermore, the charging roller 8 is powered by a power source (not shown) via the bearing 20 for charging through a nip portion 22 with the photosensitive drum 7, so that the photosensitive drum 7 is uniformly charged as it moves in an L1 direction.

Figure 6:
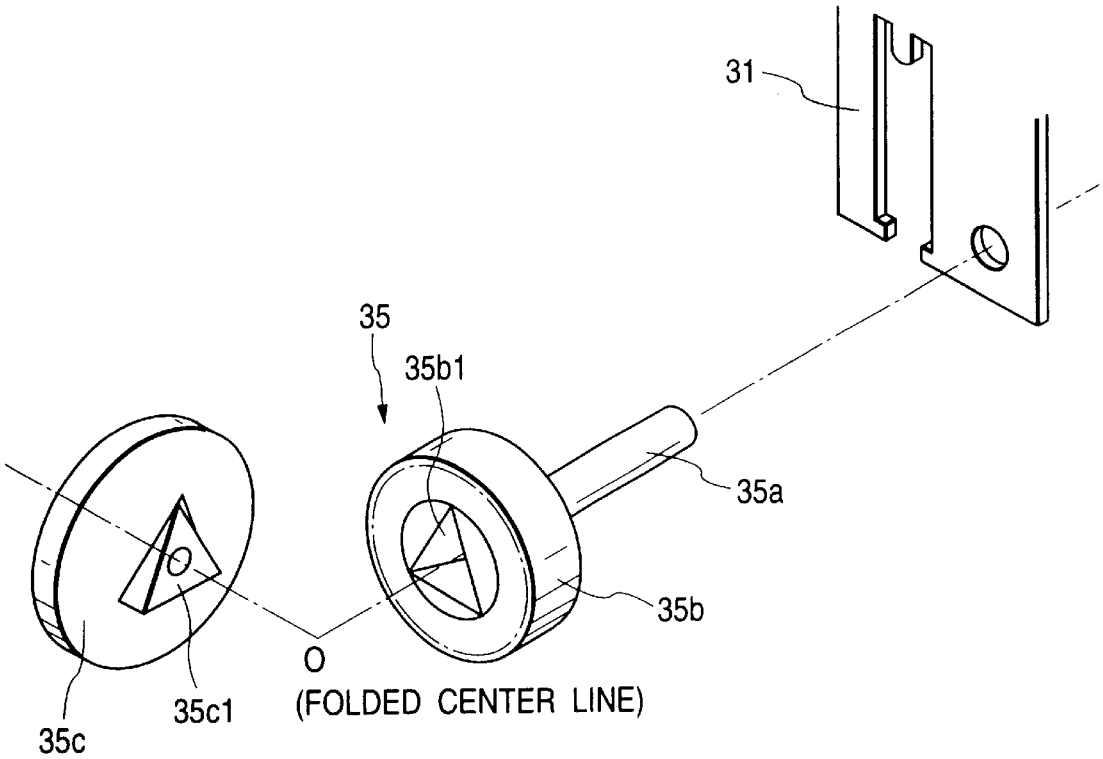
FIG. 6 is an exploded view showing a stopper mechanism of the first embodiment.

Next, the features of the invention are described. FIG. 6 shows a stopper mechanism related to the invention.

A stopper mechanism 35 of this embodiment comprises a stopper driving gear 35*b* which is a thrust generating member obtaining a rotary driving force by meshing with a drum gear (see FIG. 10) fixed to an end of the photosensitive drum 7, a shaft-shaped stopper member 35*a* provided integrally with this stopper driving gear 35*b*, and a rotating member 35*c* which is rotated with the stopper driving gear as supported by a fixed axis (not shown).

Moreover, a bearing guide 31 is provided to the apparatus main body, which accompanies the stopper mechanism 35 to guide the bearing 31.

The stopper driving gear 35*f* and the rotating member 35*c* utilize a drag generated at a contact portion of their own to generate a thrusting force, thus transmitting motive power. As shown in FIG. 6, the rotating member 35*c* is provided with a twisted triangle pole with a triangular cross section, i.e. a tapered protrusion 35*c*1. The stopper driving gear 35*b* has a twisted hole 35*b*1 formed therein which fits to this twisted triangle-pole protrusion 35*c*1.

Although the twisted triangle-pole protrusion 35*c*1 and the twisted hole 35*b*1 have the same triangle shaped cross section, the shape is not limited to that for having the same functions. Furthermore, the triangle-pole protrusion 35*c*1 and the hole 35*b*1 may be provided to either side of the stopper driving gear 35*b* and the rotating member 35*c*.

This twisted triangle pole protrusion 35*c*1 and the hole 35*b*1 are fitted to each other, to give a rotating force to the stopper driving gear 35*b*. The stopper driving gear 35*b* and the rotating member 35*c* are arranged in such a manner that a drag, when generated at the fitting portion (hereinafter called coupling portion) of the twisted triangle pole protrusion 35*c*1 and the hole 35*b*1, causes in turn a thrusting force to be generated in such a direction as to separate the stopper driving gear 35*b* and the rotating member 35*c* from each other.

Figure 7A:
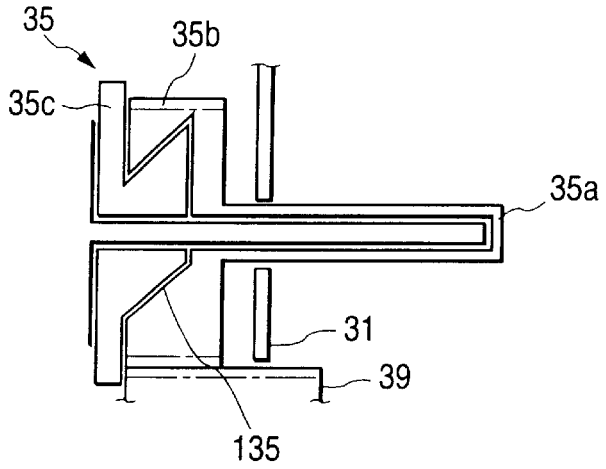
FIGS. 7A, 7B, and 7C show operations of the stopper mechanism of the first embodiment.
Figure 7B:
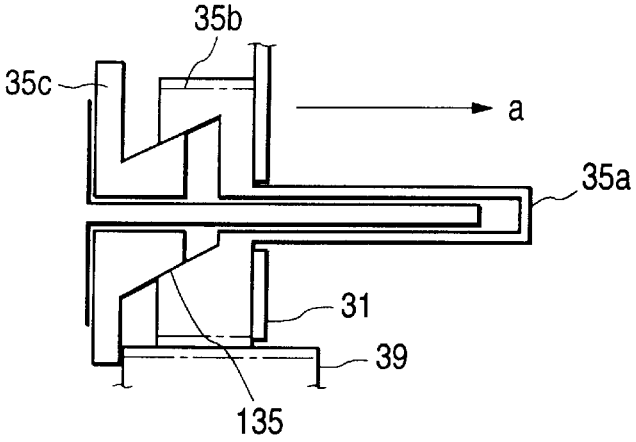
Figure 7C:
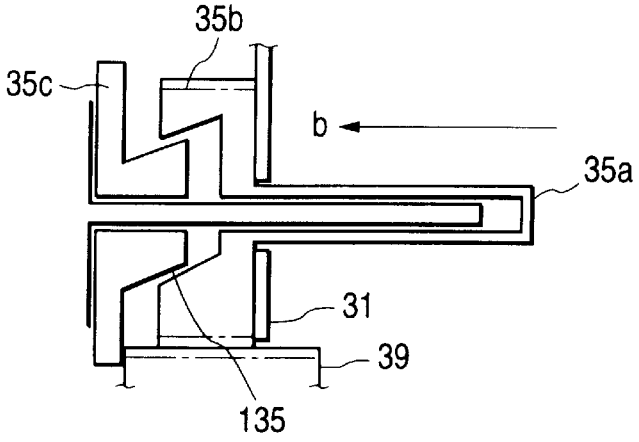

Next, such states are described against FIGS. 7A through 7C that the stopper mechanism 35 is rotating and stopped.

FIG. 7A indicates a state where the photosensitive drum 7, i.e. the drum gear 39 plus the stopper mechanism 35, has completely stopped. In this case, the coupling portion 135 is in a coupled state, so that the stopper driving gear 35*b* is separated from the bearing guide portion 31.

When the drum gear 39 rotates, the stopper driving gear 35*b* also rotates, to thereby produce a drag at the coupling portion 135, which cases, as shown in FIG. 7B, the stopper driving gear 35*b* to slide together with the stopper portion 35*a* in an arrow a direction until it abuts against the bearing guide portion 31. As far as the drum gear 39 is rotating, it remain there.

When the drum gear 39 stops rotating in FIG. 7C, the stopper driving gear 35*b* also stops. The rotating member 35*c* coupled at the coupling portion 135 continues rotating until it loses rotating energy and then stops. This rotation due inertia force causes the coupling portion 135 to generate a force in a direction (arrow b direction) opposite to the axial direction (arrow a direction) of the force generated when the photosensitive drum 7 was rotating continuously. The stopper portion 35*a* receives this force to slide in the arrow b direction.

Based on this principle, the stopper portion 35*a* slides in the arrow a direction when the drum gear 39 is continuously rotating and, when it stopped, slides in the arrow b direction and returns to its original position.

Figure 8A:
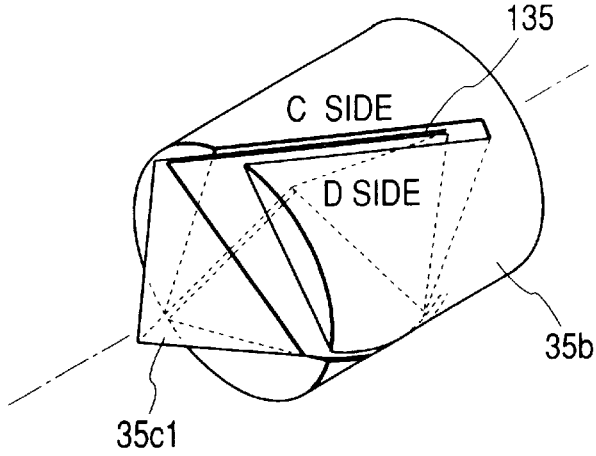
FIGS. 8A, 8B, and 8C show operating principles of the stopper mechanism of the first embodiment.
Figure 8B:
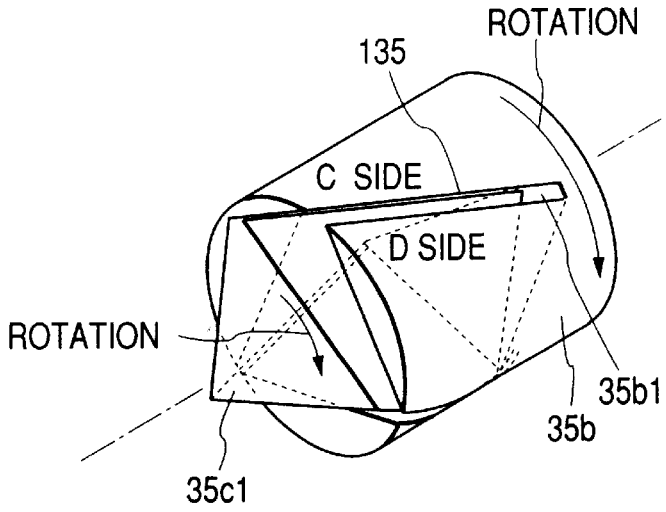
Figure 8C:
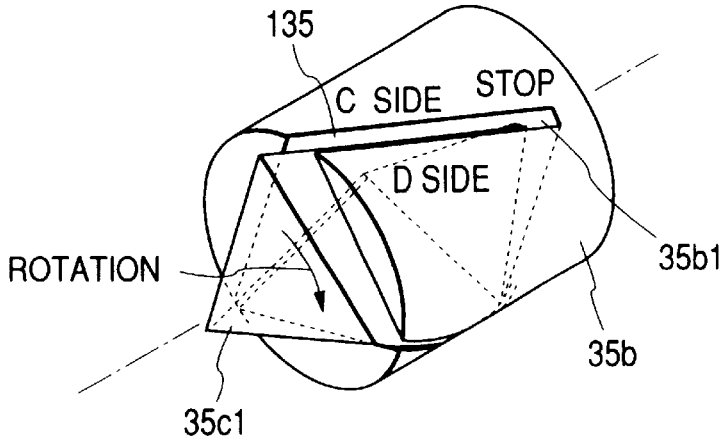

The following will describe an axial force generated at the coupling portion 135 of this triangle pole protrusion and the hole with reference to FIGS. 8A to 8C. FIGS. 8A to 8C show only a peripheral portion where the twisted triangle pole protrusion 35*c*1 and the hole 35*b*1 fit to each other.

FIG. 8A shows a state where the stopper mechanism 35 is stopped, so that the twisted triangle pole protrusion 35*c*1 is not in contact with the wall surface of the side of the hole 35*b*1 with no thrust force exerted thereon. As shown in FIG. 8B, when the twisted hole 35*b*1 side is rotated in an arrow direction, the twisted triangle pole protrusion 35*c*1 comes in contact with the wall surface side C of the hole 35*b*1. In this case, the twisted triangle pole protrusion 35*c*1 is integrally mounted with the rotating member 35*c* by an inertia force, thus generating a drag at the coupling portion 135 until the rotating member 35*c* reaches a constant speed. Since the coupling portion 135 develops such a force that separate the two from each other axially because the wall surface of the hole 35*b*1 is twisted.

FIG. 8C shows a state immediately after the photosensitive drum 7 stopped rotating, i.e. immediately after the stopper driving gear 35*b* having the twisted hole 35*b*1 is stopped. Even when the side of the hole 35*b*1 in the coupling portion 135 is stopped, the triangle pole protrusion 35*c*1 would continue rotating because it is integrally mounted with the rotating member 35*c* having an inertia force. Then, it comes in contact with the wall surface D of the hole 35*b*1. At this point in time, the coupling portion 135 develops a drag, which is converted to an axial force because of a twisted shape of the wall surface, thus producing a force for axially pulling the two to each other. This force causes the stopper portion 35*a* to be pulled back to the position shown in FIG. 8A.

Figure 9:
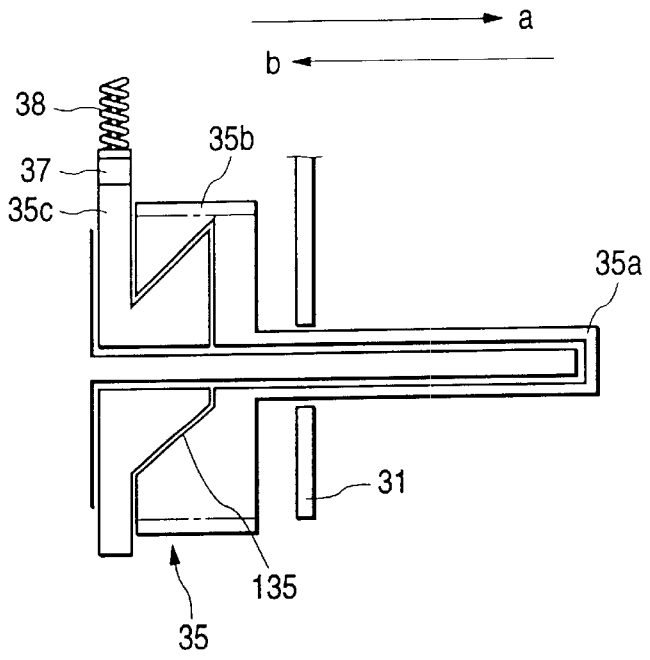
FIG. 9 shows a thrusting force generated at the stopper mechanism of the first embodiment.

In the case of the stopper mechanism 35 shown in FIGS. 7 and 8, a force can be generated for sliding the stopper portion 35*a* during rotation, i.e. a drag can be generated at the coupling portion 135. FIG. 9 shows a configuration for generating a drag at the coupling portion 135 even when the photosensitive drum 7 has reached a constant rotating speed.

The side, which receives a force, of the coupling 135 has a frictional member 37 made of felt etc. pressed against itself by an action of the compressing coil spring 38, thus having a load. The load is always imposed on the driven side during rotation, thereby making it possible to always generate a drag at the coupling portion 135 during rotation. This load, however, may also prevent the rotating member 35*c* from rotating after the photosensitive drum 7 is stopped rotating, so that it is necessary to provide the rotating member 35*c* with a sufficient inertia force.

The following will describe along FIGS. 10 to 13 a state where the above-mentioned stopper mechanism 35 is used as separation control means of the charging roller against the photosensitive drum 7.

The separation control means of this embodiment comprises the stopper mechanism 35 and the untoothed gear 34 which is fitted to the core metal 8*a* of the charging roller 8 to mesh with the drum gear 39.

Such a configuration is employed here that an inter-axial distance when the untoothed gear 34 is meshing with the drum gear 39 may be larger than that when the charging roller 8 is pressure-contacted against the photosensitive drum 7.

Figure 10:
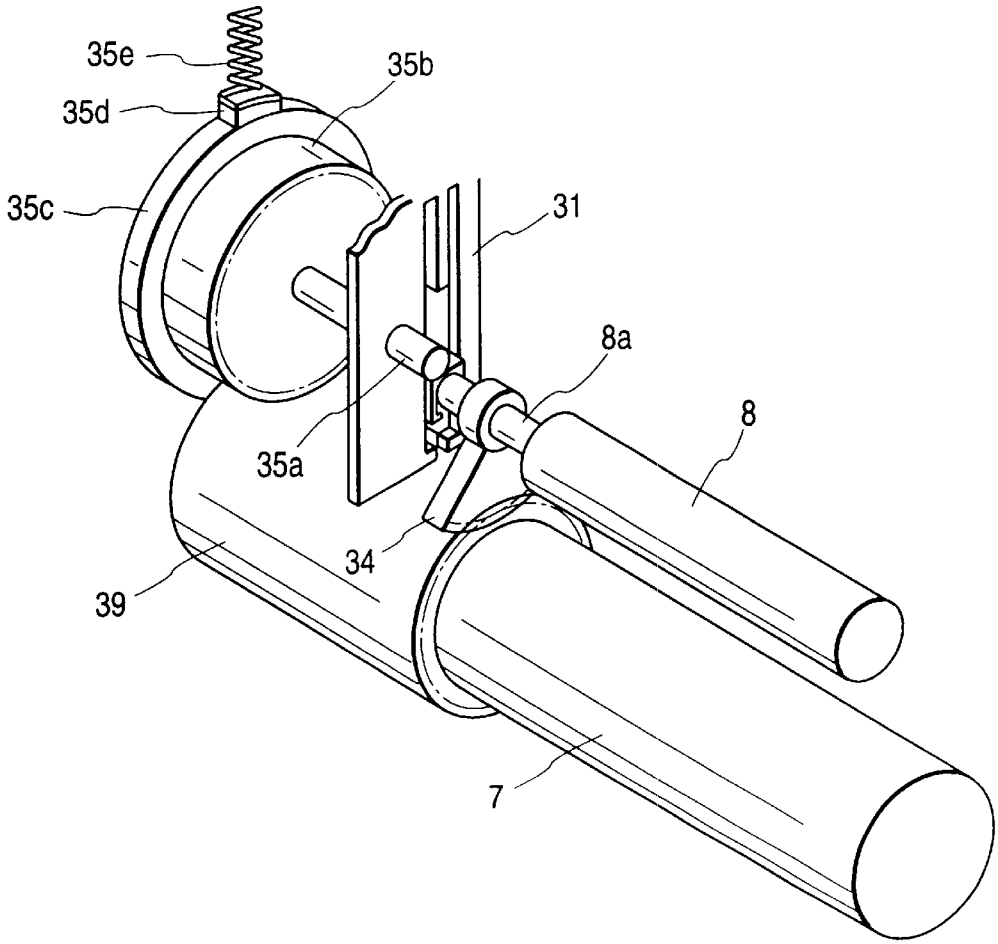
FIG. 10 is a perspective view showing a state where the charging roller is separated from the photosensitive drum when the stopper mechanism of the first embodiment is applied to separation control means for the charging roller.

FIG. 10 shows a state where the untoothed gear 34 is meshing with the drum gear 39 with the charging roller 8 being separated from the photosensitive drum 7.

The drum gear 39 receives a driving force from the main body of the image forming apparatus, to rotate the stopper driving gear 35*b* meshing with the photosensitive drum 7 and the drum gear 39. Furthermore, the charging roller 8 and its core metal 8*a* rotate as driven by the rotation of the photosensitive drum 8*a* or by any other driving source. The untoothed gear 34 fit to the core metal 8*a* receives a frictional force from the core metal 8*a*, to use this frictional force as a driving source.

Figure 11:
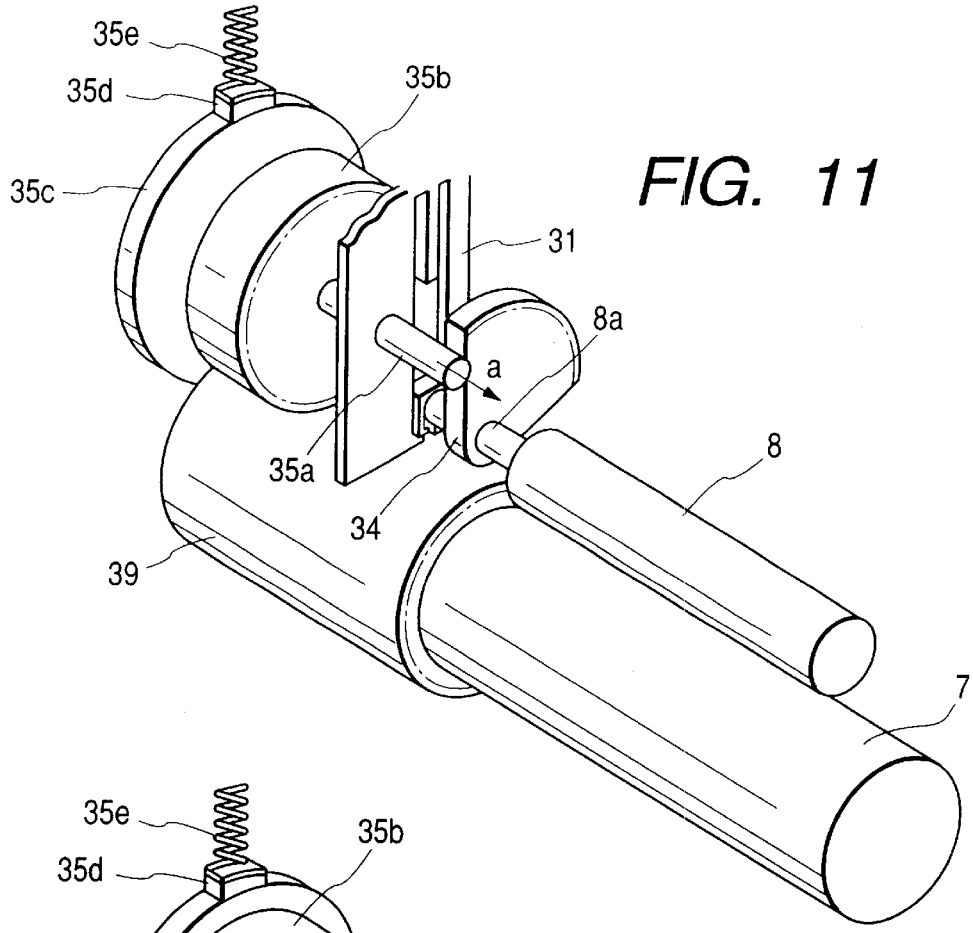
FIG. 11 is a perspective view showing a state of the stopper mechanism of the first embodiment during image formation.

FIG. 11 shows a state where an image is being formed. When the drum gear 39 is rotating, the stopper member 35*a* slides in the arrow a direction in the figure and enters a rotating plane of the untoothed gear 34, thereby stopping its rotation. This state is held as far as the drum gear continues to rotate. In this case, the untoothed gear 34 cannot mesh with the drum gear 39. That is, there is no member provided for regulating the inter-axial distance between the charging roller 8 and the photosensitive drum 7, so that the charging roller 8 is pressed against the photosensitive drum 7 by a force from a biasing member 21 (see FIG. 5), to form an image in this state.

Figure 12:
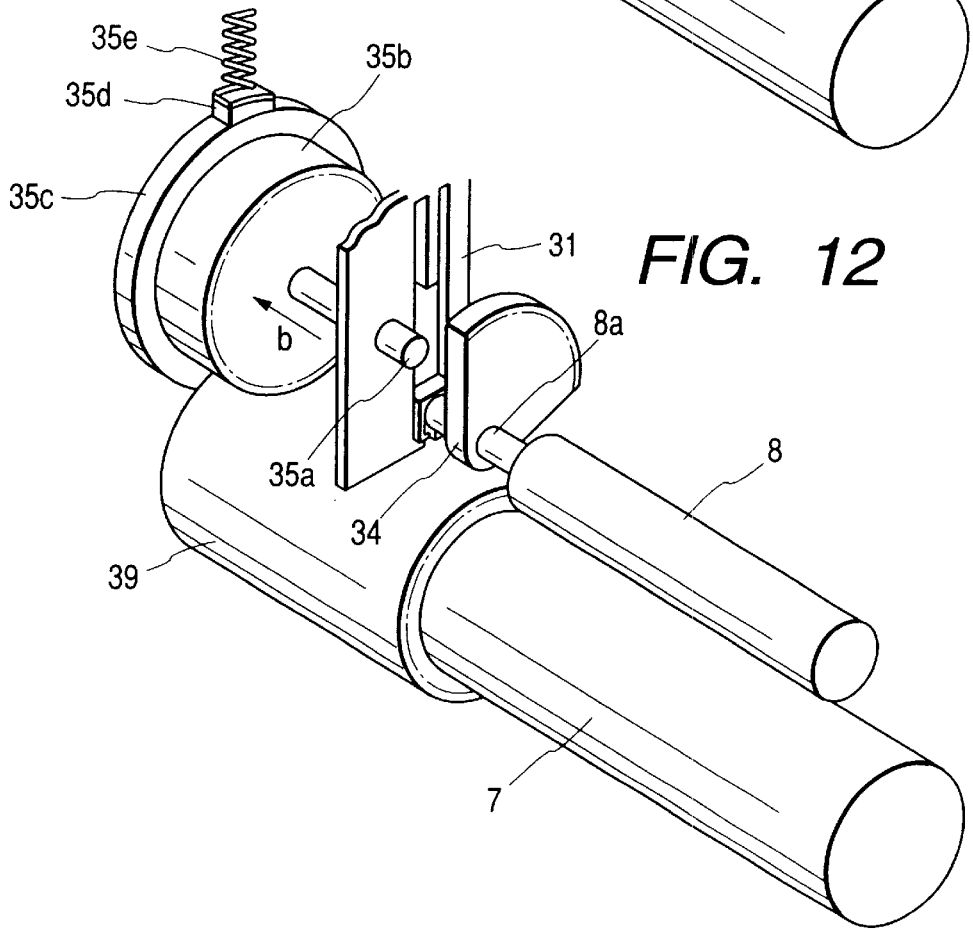
FIG. 12 is a perspective view showing a state immediately after a drum gear is stopped when an image is formed in the first embodiment.

The charging roller 8 is separated in the following order. First, the drum gear 39 is once stopped when an image is formed and then the drum gear 39 is rotated by a constant angle again, thus completing the separation. FIG. 12 shows a state immediately after the drum gear 39 is stopped after the image formation.

First, the stopper member 35*a* stops the drum gear 39 from rotating and then slides in the arrow b direction in the figure. In this state, the untoothed gear 34 is relieved of rotation regulation. The untoothed gear 34, however, stays at a position where the drum gear 39 stopped and so does not mesh with the drum gear 39 yet. That is, the charging roller 8 is still pressure-contacted with the photosensitive drum 7.

Figure 13:
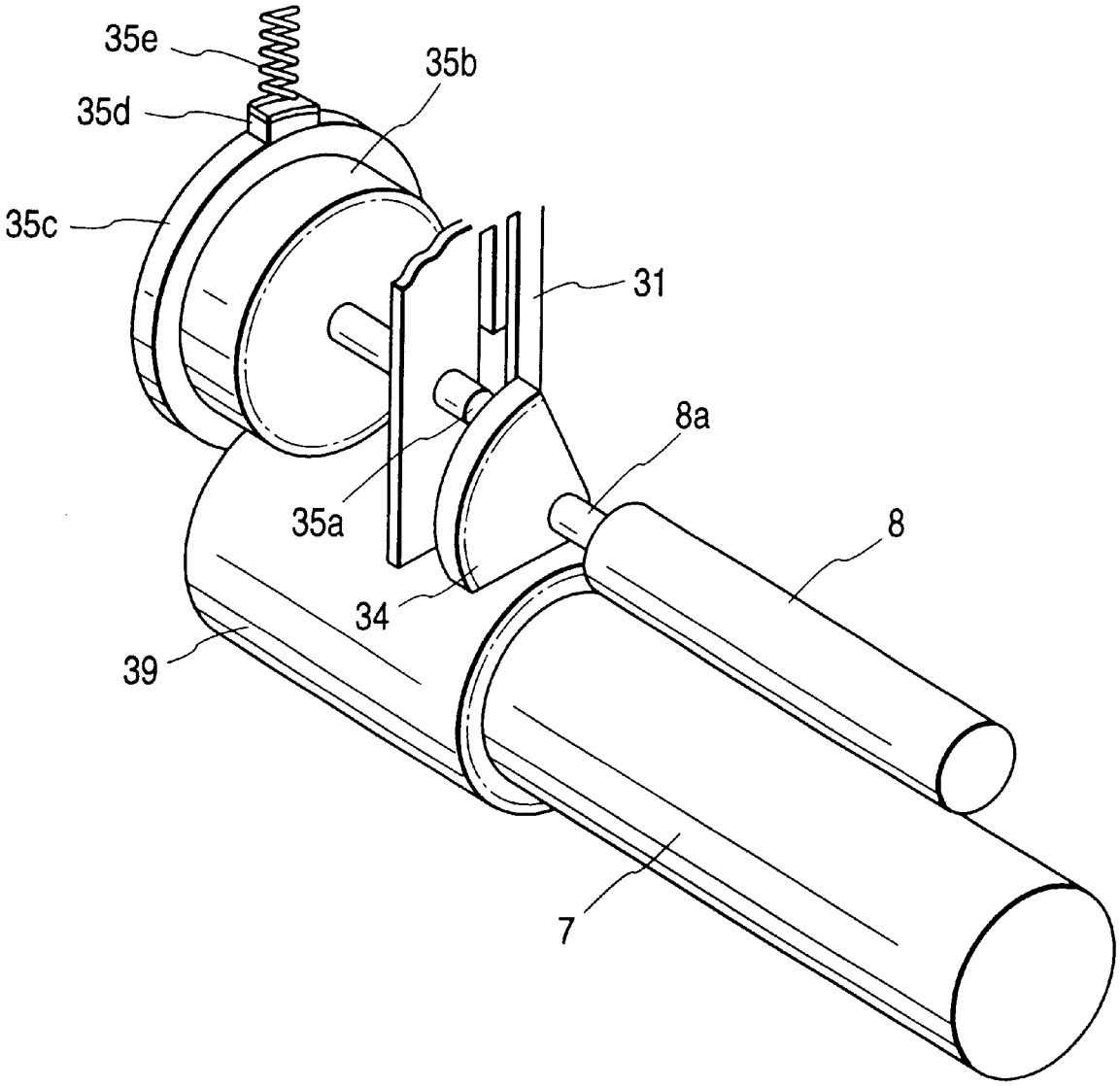
FIG. 13 is a perspective view showing a state where the drum gear is further rotated in order to separate the charging roller from the state of FIG. 12 in the first embodiment.

FIG. 13 shows a state where the drum gear 39 is rotated again to separate the charging roller 8.

In this state, although the stopper member 35*a* slides again into the rotation plane of the untoothed gear 34, the untoothed gear 34 also starts rotating at the same time as the drum gear 39 starts rotating, so that the untoothed gear 34 cannot be stopped from rotating. The untoothed gear 34 is stopped when it has rotated to mesh with the drum gear 39, to rotate it by such an angle as to take the charging roller 8 to a complete separation position. When it is stopped, return is made to such a state where the charging roller 8 is separated.

As mentioned above, according to this embodiment, except when an image is being formed, in the means for separating the charging roller from the photosensitive drum, by using the above-mentioned stopper mechanism including a stopper driving gear, a stopper member, and a rotating member at its portion for controlling its own operation and suspension, when the photosensitive drum is rotating, a thrust force generated at the coupling portion 135 of the stopper driving gear and the rotating member can be utilized to slide the stopper member, so that even when the photosensitive drum stopped rotating, the rotating continues to rotate for a while to generate a thrust force opposite to the coupling portion 135 to return the stopper member to its original position, thus making it possible to touch the charging roller to and separate it from the photosensitive drum without using a solenoid or any other electric component and also without rotating the photosensitive drum in a reverse direction.

Second Embodiment

Figure 14:
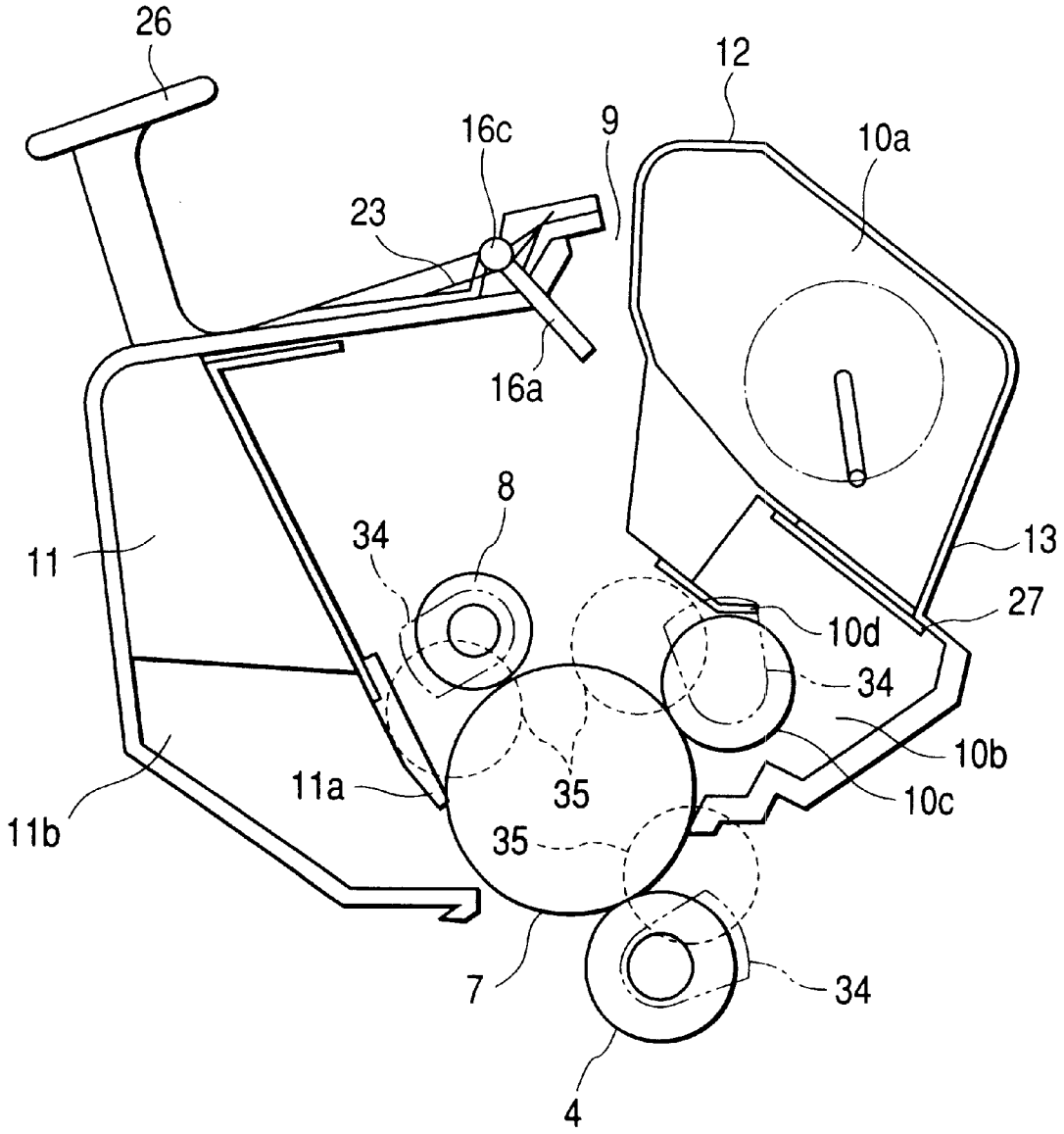
FIG. 14 shows a state of a second embodiment during image formation where the stopper of the first embodiment is applied further to a developing sleeve and a transferring roller.
Figure 15:
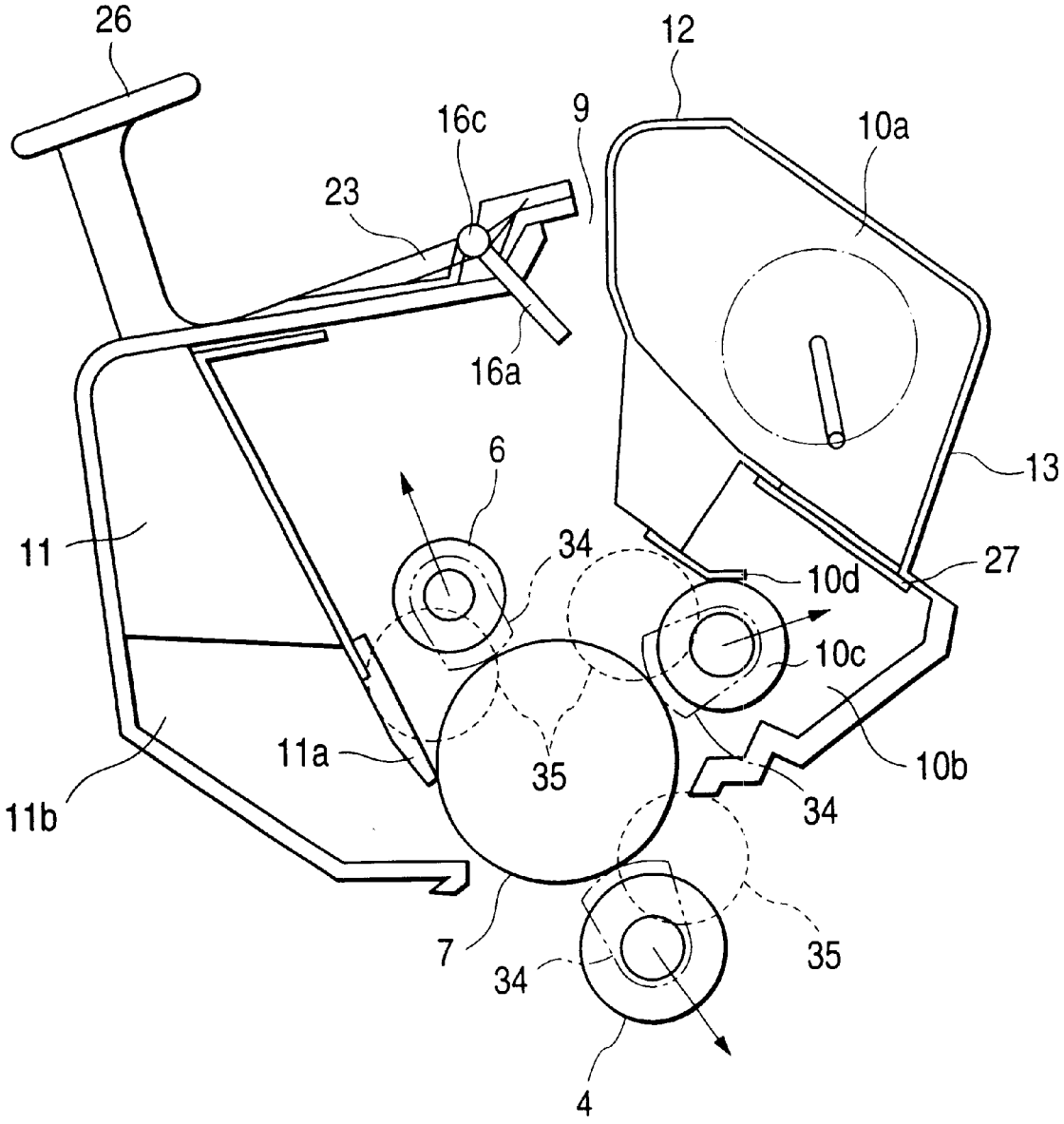
FIG. 15 shows transition from the image forming state of FIG. 14 to a state of separation of the charging roller, the developing sleeve, and the transferring roller.

The following will describe a second embodiment of the invention with reference to FIGS. 14 and 15.

In contrast to the above-mentioned first embodiment wherein the stopper mechanism relating to the invention is applied as the contacting/separating control means of the charging roller 8 with respect to the photosensitive drum 7, this embodiment has such a configuration shown in FIG. 14 that the stopper mechanism 35 and the untoothed gear 34 are attached to the charging roller 8 serving as the process means as well as the respective core metals of the developing roller 10*c* and the transferring roller 4.

When being driven in rotation, the respective process means are pressed against the photosensitive drum 7, so that the process means 8, 10*c*, and 4, when the untoothed gear 34 is meshed, can be separated from the photosensitive drum 7 in an arrow direction as shown in FIG. 15. The description of the operating principles and procedures is omitted here.

Third Embodiment

Figure 16:
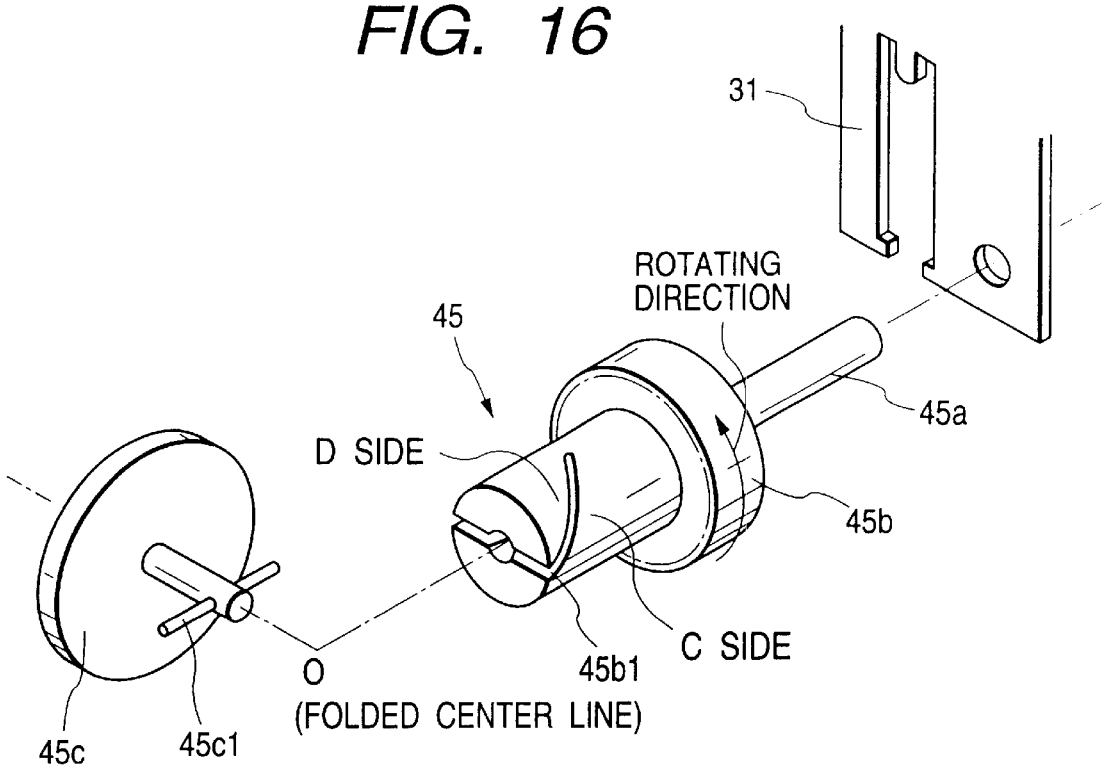
FIG. 16 is an exploded view showing the stopper mechanism of a third embodiment.

The following will describe a third embodiment with reference to FIG. 16.

A stopper mechanism 45 of this embodiment has a configuration different from that of the stopper mechanism 35 of the first embodiment but has the same actions.

In this embodiment, a twisted groove 45*b*1 is formed in the side of a stopper driving gear 45*b*, which is a member for producing a thrust force, while on the side of a rotating member 45*c* is attached a protrusion 45*c*1 which meshes with this groove 45*b*1 as rotating therein.

When the stopper driving gear 45*b* side is rotated in an arrow direction in the figure, the protrusion 45*c*1 comes in contact with the C side of the groove 45*b*1, to produce such a thrust force as to separate the stopper driving gear 45*b* side and the rotating member 45*c* from each other. After the stopper driving gear 45*b* is stopped, the rotating member 45*c* continues to rotate, so that the protrusion 45*c*1 comes in contact with the D side of the groove 35*b*1, to produce such a thrust force that the two attract each other.

Fourth Embodiment

Figure 17:
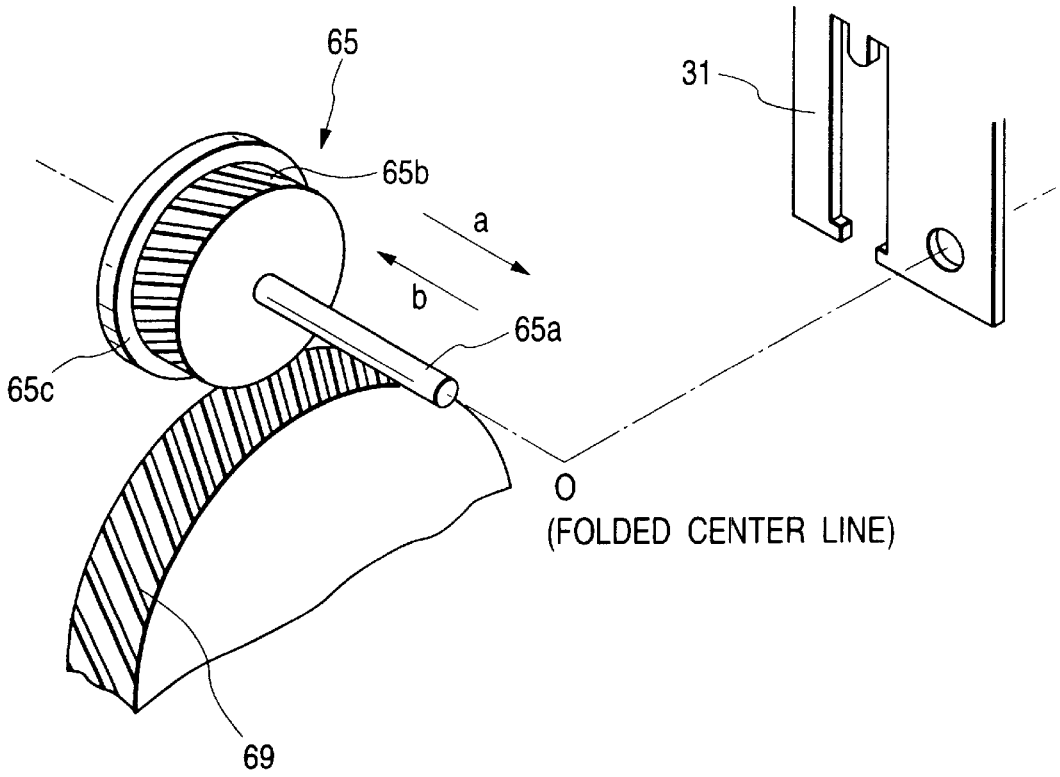
FIG. 17 is an exploded view showing the stopper mechanism of a fourth embodiment.

The following will describe a fourth embodiment with reference to FIG. 17.

A stopper mechanism of this embodiment has such a configuration as to use a thrust force generated by a helical gear as shown in FIG. 17.

A stopper driving gear 65*b* is a helical gear and driven by a drum gear 69, which is another helical gear. The stopper driving gear 65*b* and a stopper member 65*a* are integrated into one component. When the drum gear 69 meshes with the stopper driving gear 65*b*, a thrust force is produced by a twisted tooth surface of the helix.

When the drum gear 69 is rotating, this thrust force causes the stopper member 65*a* to slide in an arrow a direction. When the drum gear 69 stopped, due to kinetic energy of the rotating member 65, the stopper driving gear 65*b* would rotate the drum gear 69 (but the drum gear does not rotate). In this case, the force transfer relationship is opposite to that when the drum gear 69 is rotating, thus producing an opposite-directional thrust force which is generated at the tooth surface of the helix. With this, the stopper member 65*a* slides in an arrow b direction.

Fifth Embodiment

The following will describe a fifth embodiment with reference to FIGS. 18 to 21.

Figure 18:
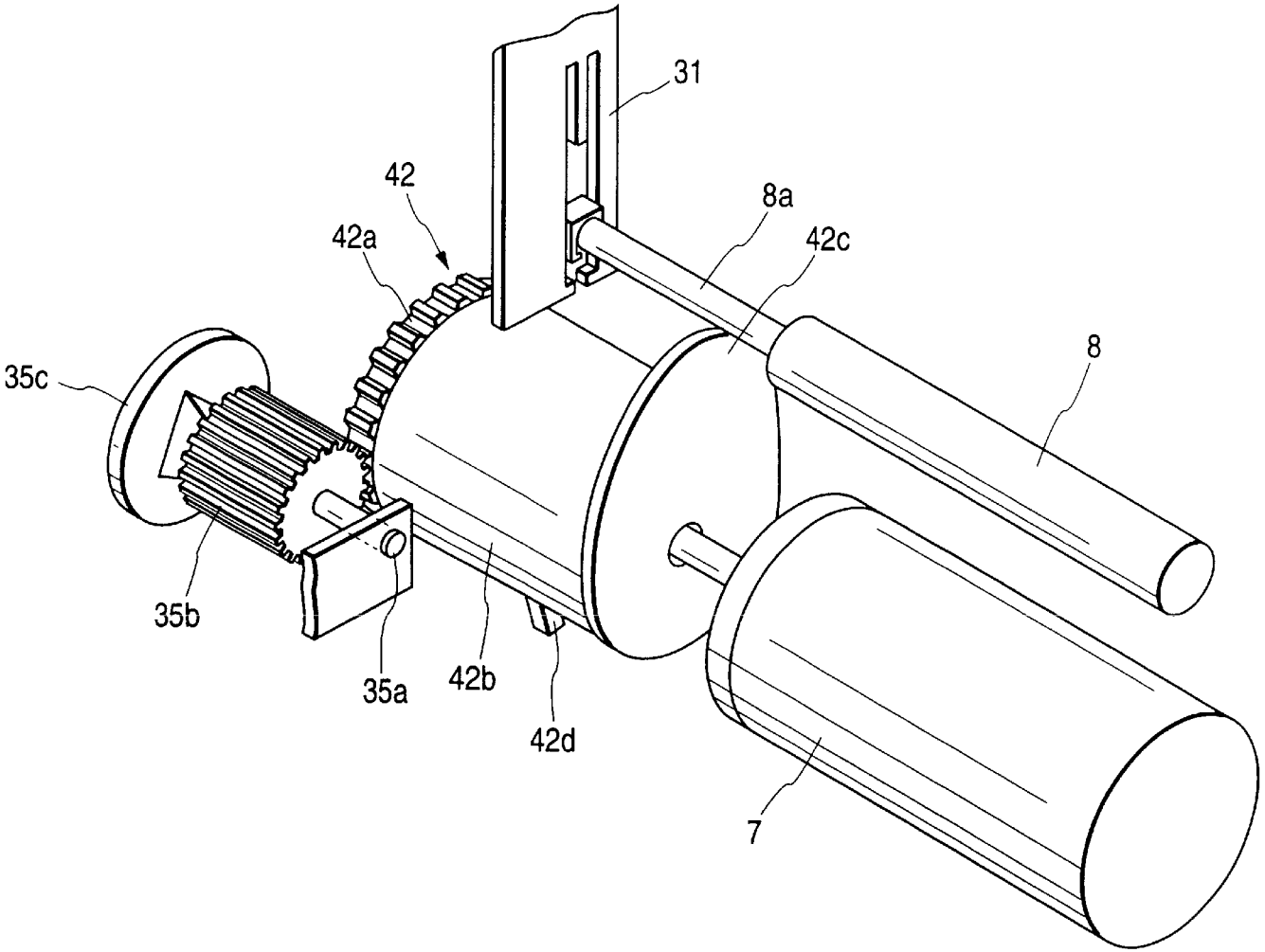
FIG. 18 is a perspective view showing a state where the charging roller is separated from the photosensitive drum when the stopper mechanism and a spring clutch of a fifth embodiment are applied to the charging-roller separation control means.

As shown in FIG. 18, charging roller separation control means of this embodiment comprises the stopper mechanism 35 of the above-mentioned first embodiment and a spring clutch 42 provided on the same axis as the photosensitive drum 7.

The spring clutch 42 of this embodiment has a roughly cylindrical spring clutch control portion 42*b* in such a configuration that at its one end, i.e. at its input side separate from the photosensitive drum 7 is fixed an input gear 42*a* which meshes with the stopper driving gear 35*b* and, at the other end, i.e. at its output side is fixed a cam 42*c* which engages with the core metal 8*a* of the charging roller 8, and also at the spring clutch control portion 42*b* is provided a protrusion 42*d* which is brought into contact with and separated from the stopper member 35*a* when it moves back and forth.

FIG. 18 shows a state where the charging roller 8 is separated from the photosensitive drum 7.

Figure 19:
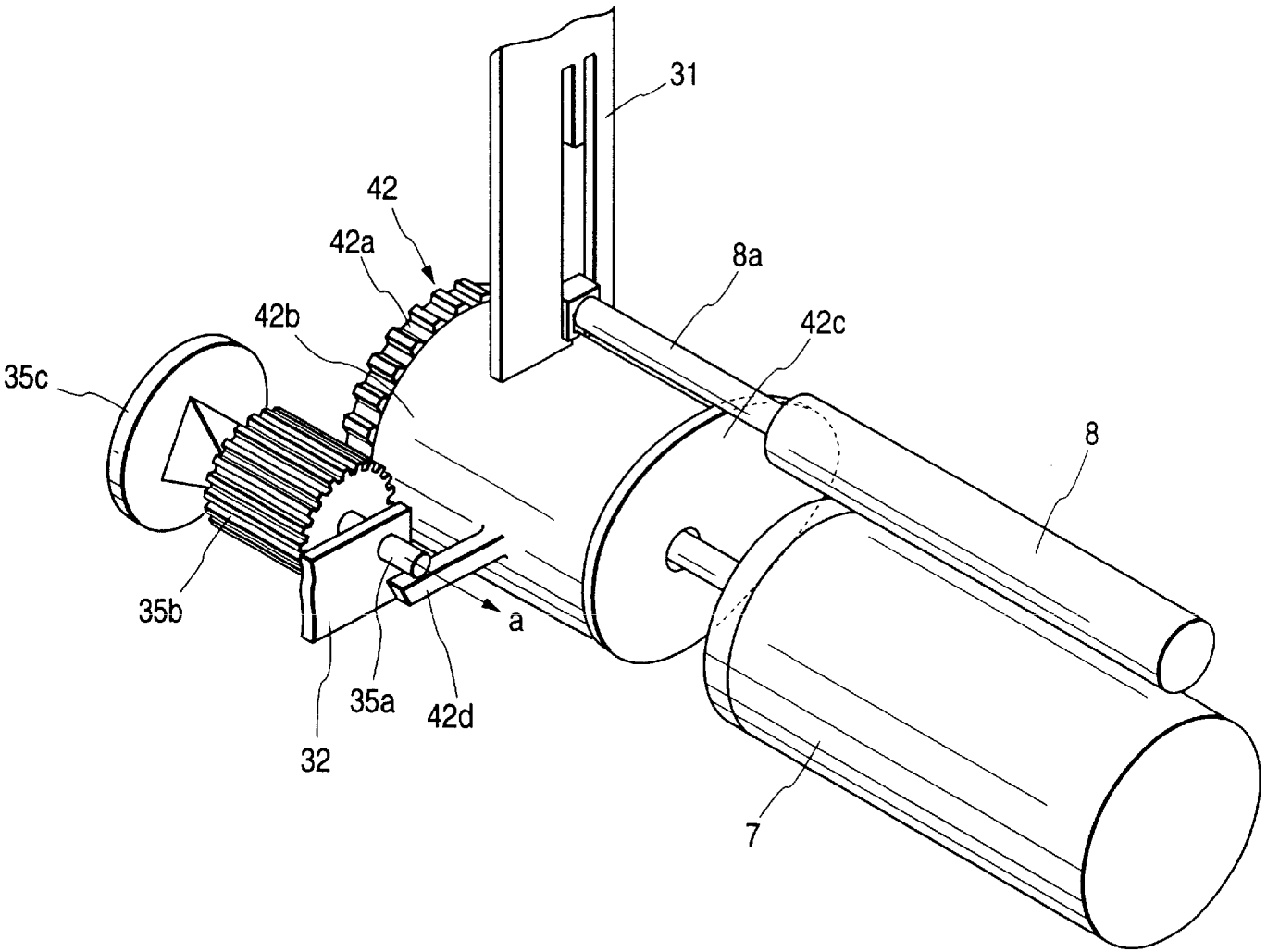
FIG. 19 is a perspective view showing a state of the stopper mechanism and the spring clutch of the fifth embodiment during image formation.

FIG. 19 shows a state where an image is being formed, wherein the cam 42*c* is stopped at a position where it does not come in contact with the core metal 8*a* of the charging roller 8. More precisely, when the spring clutch 42 is transmitting its driving force, the input gear 42*a*, the spring clutch control portion 42*b*, and the cam 42*c* rotate simultaneously. When they start rotating, the stopper member 35*a* slides in an arrow a direction until it abuts against the protrusion 42*d*, whereupon the rotation stops, to terminate the transmission of the driving force of the spring clutch 42, thus stopping the cam 42*c* from rotating immediately.

The following will describe the order of separating the charging roller 8 from the photosensitive drum 7.

During image formation, i.e. when the photosensitive drum 7 is continuously rotating, as shown in FIG. 19, the stopper member 35*a* slides in the arrow a direction with the stopper driving gear 35*b* being located as abutting against a guide 32. At this abutting position, the protrusion 42*d* of the spring clutch 42 is stopped from rotating. The cam 42*c* always stops at a constant position, which is determined by its phase with respect to the protrusion 42*d*.

Figure 20:
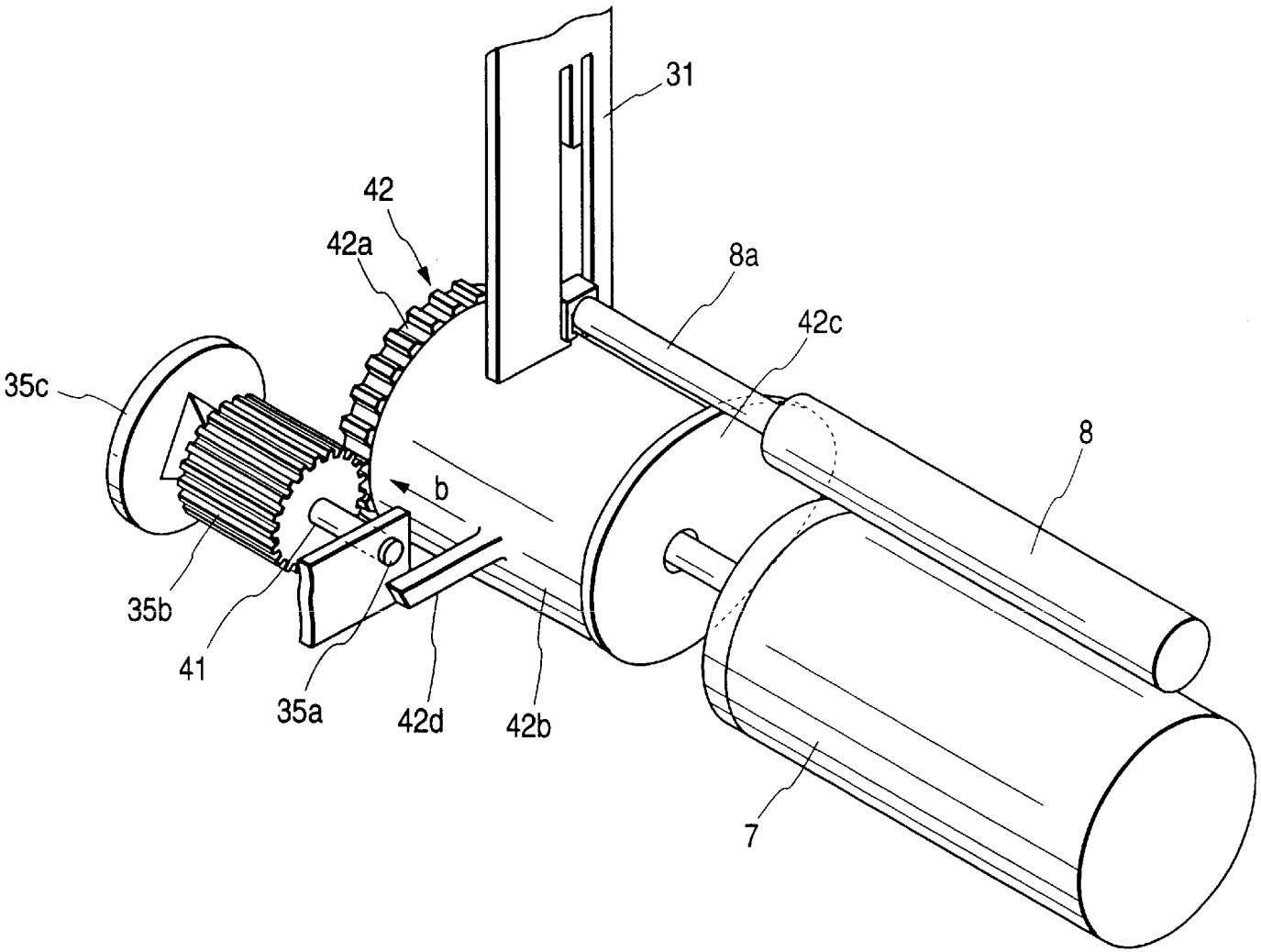
FIG. 20 is a perspective view showing a state immediately after the drum gear is stopped after image formation in the fifth embodiment.

FIG. 20 indicate s a state where the apparatus stopped once after image formation. In this state, like in the case of the first embodiment, the stopper member 35*a* slides in the arrow b direction due to a force of the compressive spring 35*e* (see FIG. 12). With this, there is provided nothing for regulating the rotation of the protrusion 42*d* of the spring clutch 42.

Figure 21:
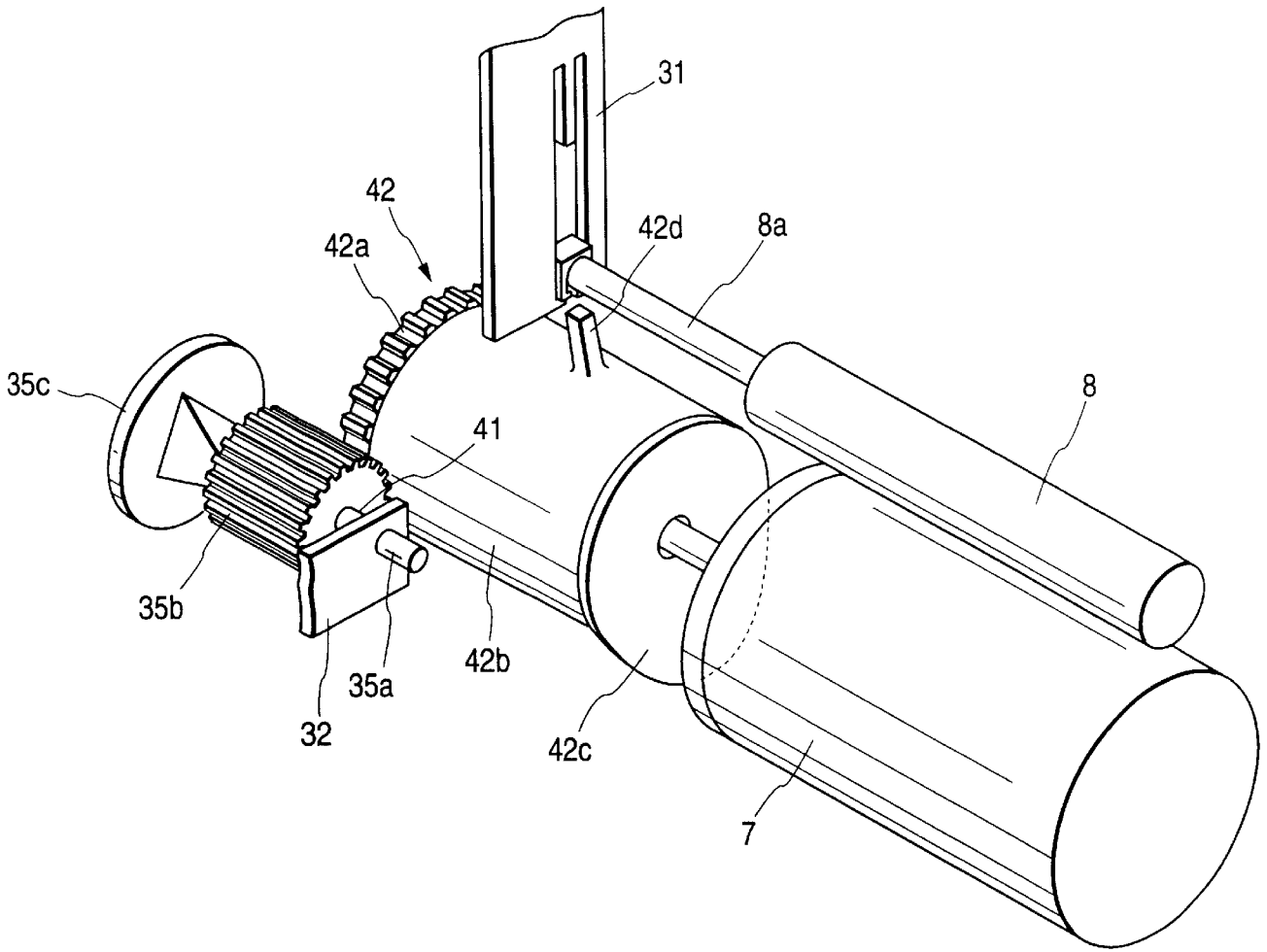
FIG. 21 is a perspective view showing a state where the drum gear is further rotated in order to separate the charging roller from the state of FIG. 20 in the fifth embodiment.

FIG. 21 indicates a state where the input gear 42*a* is rotated again to rotate the cam 42*c*.

Since the position where the cam 42*c* has stayed can be calculated from its phase with respect to the protrusion 42*d* of the spring clutch 42, the amount of this rotation is such that the cam 42*c* can be located at such a position as to separate the charging roller 8 from the photosensitive drum 7. By stopping the rotation of the input gear 42*a* at this position, the separation state can be maintained to make return to the state of FIG. 18.

As mentioned above, the actions of the stopper mechanism 35 and the spring clutch 42 bring about almost the same effects as the first embodiment.

Although this embodiment has been described with reference to a case where the invention is applied to the separating mechanism of the charging roller, it can be applied also to the developing sleeve and the transferring roller as described with the second embodiment.

Sixth Embodiment

Figure 22:
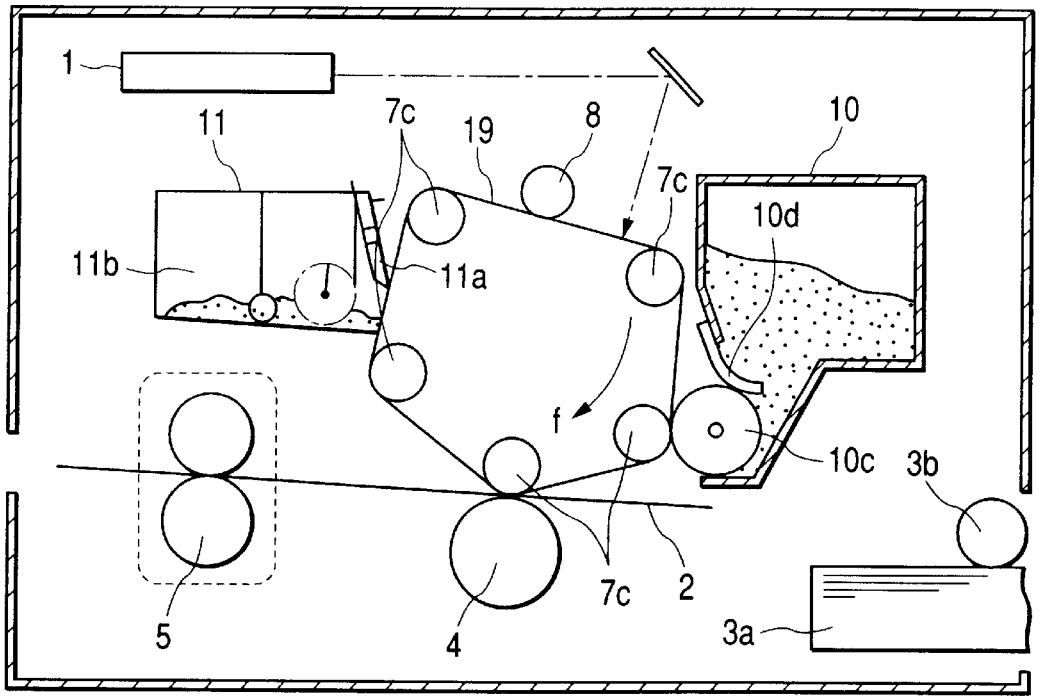
FIG. 22 is a schematic configuration diagram showing an image forming apparatus provided with a photosensitive belt related to a sixth embodiment.

The following will describe a sixth embodiment with reference to FIG. 22.

Although the above-mentioned embodiments have been described with reference to an example of the invention where the photosensitive drum 7 is provided as the electrophotographic photosensitive body of the process cartridge, it can be applied also to a case where the photosensitive belt 19 is provided as the electrophotographic photosensitive body like in the case of this embodiment.

In the case of this embodiment, the photosensitive belt 19 is engaged over five rollers 7*c* which rotate in an arrow f direction, during which almost the same processes as those described with the first embodiment are performed to form an image such as uniform charging by the charging roller 8, exposure by the optical system 1, development by the developing apparatus 10, transferring by the transferring roller 4, and cleaning by the cleaning apparatus 11. The detailed description of the image forming processes are, therefore, omitted here.

Seventh Embodiment

Figure 23:
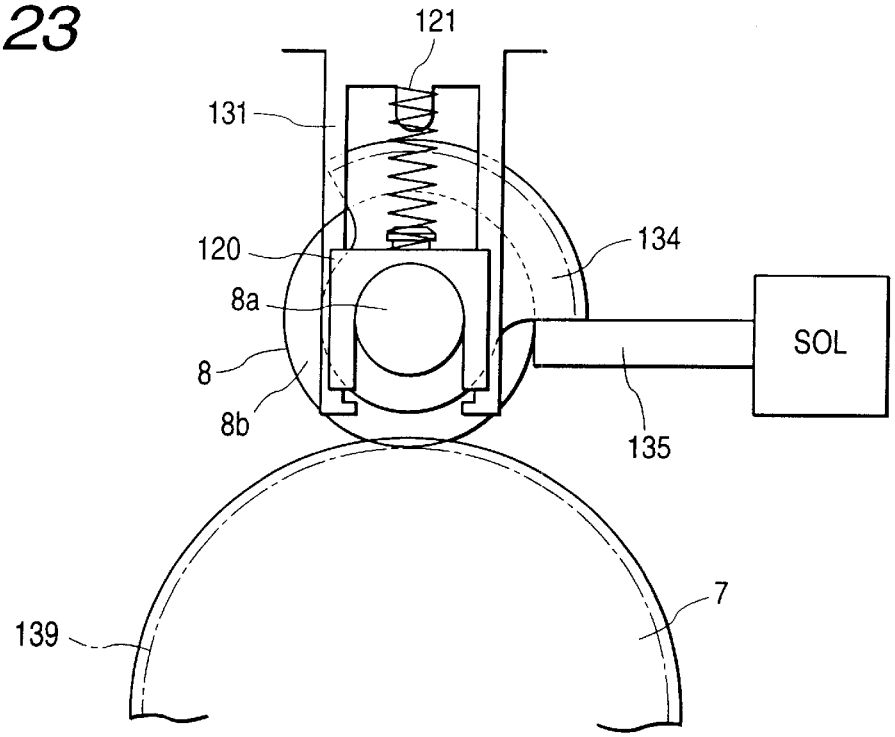
FIG. 23 is an illustration of the charging roller of one embodiment of the invention as viewed from an axis of the photosensitive drum.

As shown in FIG. 23, the core metal 8*a* of the charging roller 8 is supported by the bearing 120, which is in turn supported by the guide 131 in such a manner as to be movable back and force in an direction of an axis of the photosensitive drum 7 and also is pressed by the biasing member 121 toward the photosensitive drum 7, thus pressing the charging roller 8 against the surface of the photosensitive drum 7. The charging roller 8 is rotated as driven by the photosensitive drum 7 or by another driving means not shown in the figure.

In FIG. 23, a reference numeral 134 indicates for example a fan-shaped untoothed gear with part of it cut off or providing a gear and a reference numeral 135 indicates a rotation regulating member (stopper) for regulating the rotation of the untoothed gear 134. A reference numeral 139 indicates the drum gear which rotates in synchronization with the photosensitive drum 7.

Figure 24:
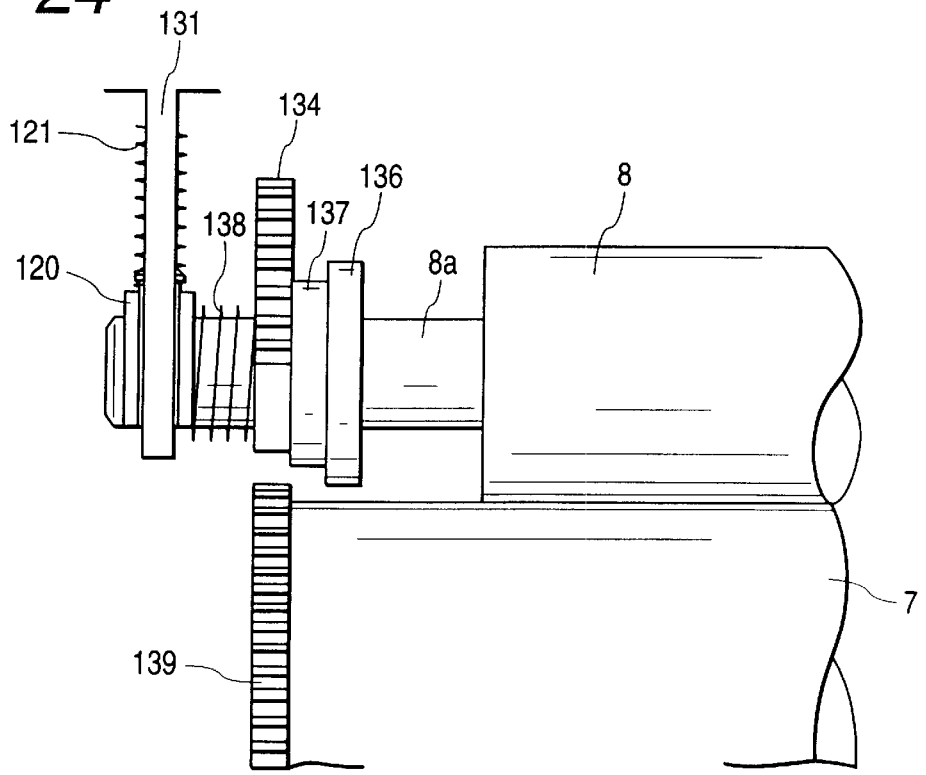
FIG. 24 is a side view with respect to FIG. 23.

FIG. 24 is a side view corresponding to FIG. 23. The core metal 8*a* of the charging roller 8 is partially deformed into a flange portion 136, which is fixed to a frictional member 137 made of for example felt, cork, or rubber, to utilize a compressive coil 138 covering the core metal 8*a*, thus pressing the untoothed gear 134 with the core metal 8*a* inserted therethrough against the frictional member 137.

Figure 25A:
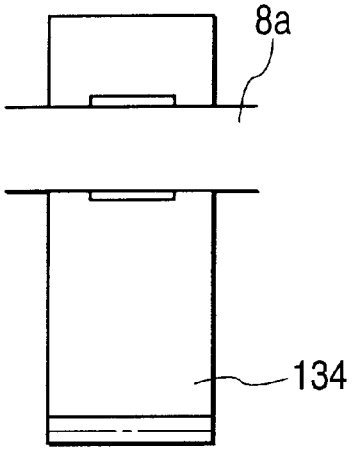
FIGS. 25A and 25B show a variation for receiving a rotating force from a core metal of the charging roller.
Figure 25B:
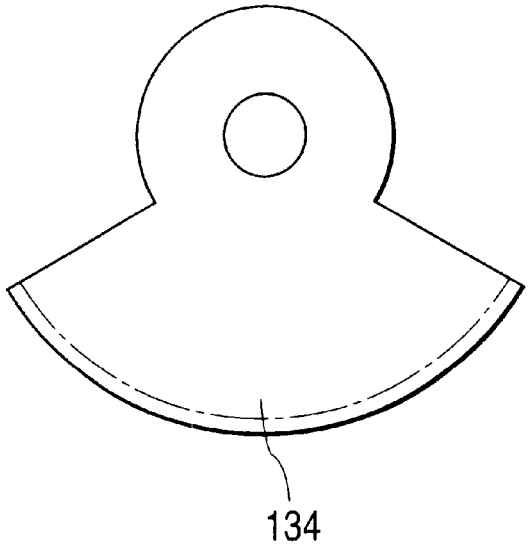
Figure 26A:
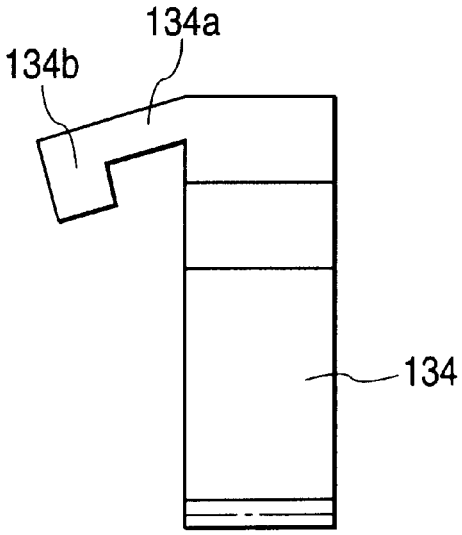
FIGS. 26A and 26B show another variation receiving a rotating force from the core metal of the charging roller.
Figure 26B:
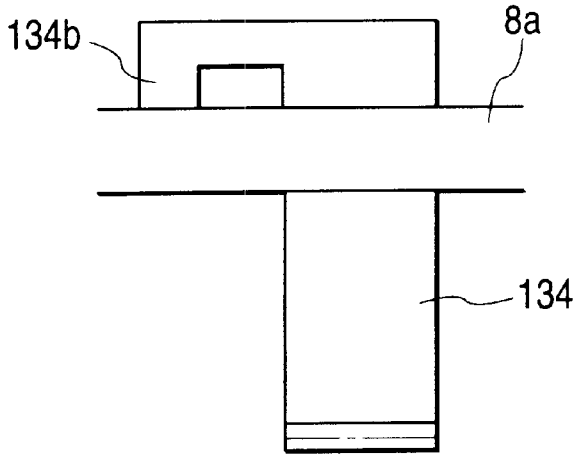

Although in FIG. 24 the untoothed gear 134 has been driven in rotation by the charging roller core metal 8*a* by the method of pressing the untoothed gear 134 against the frictional member 137, it may be rotated by a method of, as shown in FIGS. 25A and 25B, pressing in part of the coupling portion of the untoothed gear 134 and the core metal 8*a* or by a method of, as shown in FIG. 26A, integrating a springing portion 134*a* and a pressing portion 134*b* together to the untoothed gear 134 and then fitting it, as shown in FIG. 26B, to the core metal 8*a*, thus utilizing the pressing portion 134*b* to obtain a driving force from the core metal 8*a*.

Figure 27B:
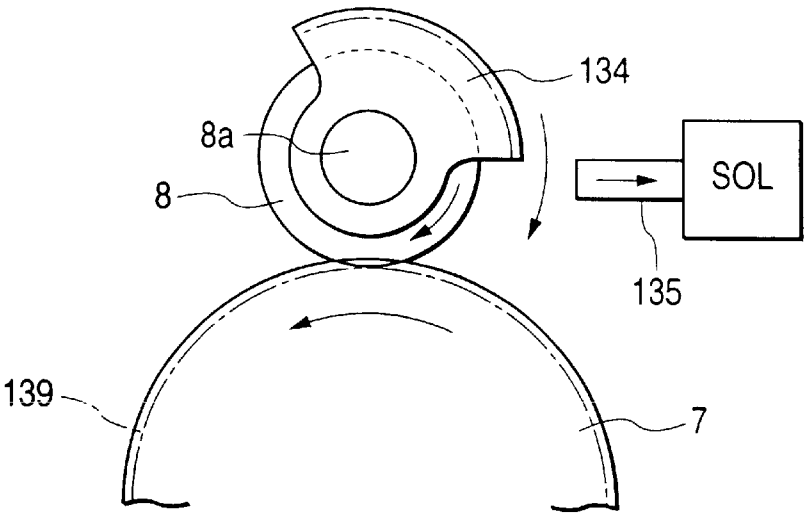
FIGS. 27A and 27B show contacting/separating operations of the charging roller in the embodiment of FIG. 23.
Figure 27A:
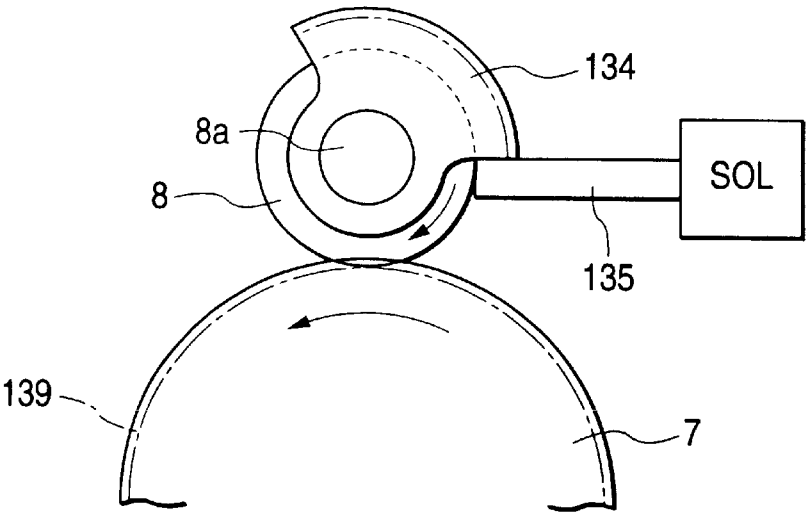

As shown in FIG. 27A, when the photosensitive drum 7 is rotating, the charging roller 8 and its core metal 8*a* also rotate, thus giving a rotating force via the frictional member 137 to the untoothed gear 134. If, however, prevented from rotating by the stopper (rotation regulating member) 135 arranged near the charting roller 8, the untoothed gear 134 stops there. In this state, the untoothed gear 134 and the drum gear 139 do not mesh with each other, to leave the charging roller 8 as pressed against the photosensitive drum 7. This state is maintained as far as the photosensitive drum 7 continues to rotate for image formation.

Figure 28B:
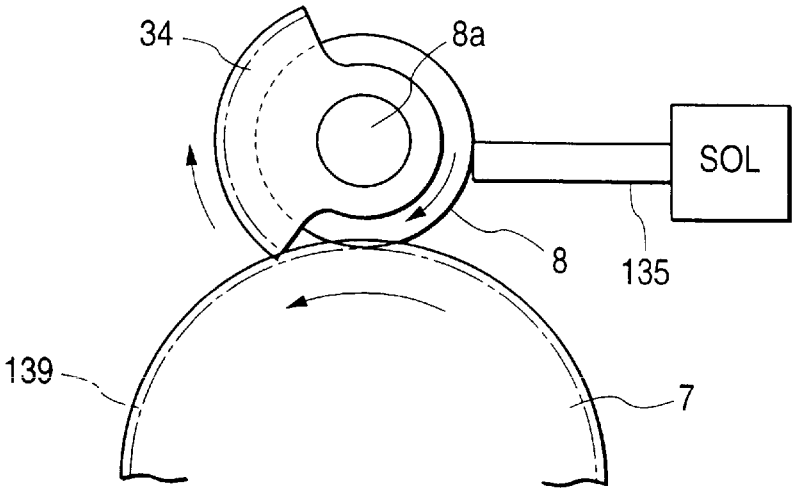
FIGS. 28A and 28B show further contacting/separating operations of the charging roller in the embodiment of FIG. 23.
Figure 28A:
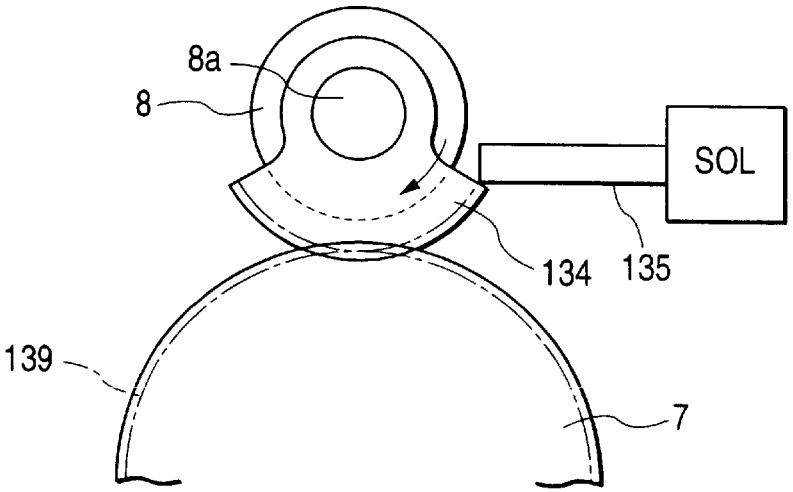

To initiate the operation of separating the charging roller 8, first, as shown in FIG. 27B, regulation disabling means, for example, a solenoid or a motor is used to permit the stopper 135 to escape from the untoothed gear 134 to a non-contacting position. With this, the untoothed gear 134 is driven in rotation by the core metal 8*a*, to mesh with the drum gear 139. In this case, an inter-pitch distance between the untoothed gear 134 and the drum gear 139 is made larger beforehand than a sum distance of a radius of the charging roller 8 and that of the photosensitive drum 7. When a gear portion of the untoothed gear 134 has rotated onto a straight line connecting an axis of the charging roller 8 and that of the photosensitive drum 7, the charging roller 8 is separated from the photosensitive drum 7 by a constant distance as shown in FIG. 28A. If the photosensitive drum 7 is stopped from rotating when a constant time lapse has elapsed after the stopper 135 which had regulated the rotation of the untoothed gear 134 was disabled, the charging roller 8 stays as separated from the photosensitive drum 7.

The following will describe a method of returning the charging roller 8 to such a state of being pressed against the photosensitive drum 7 in order to form an image again. First, the drum gear 139 is rotated with the untoothed gear 134 as meshed with the drum gear 139. With this, the untoothed gear 134 is driven in rotation by the drum gear 139. When the gear portion is disengaged from the drum gear 139, the charging roller 8 is completely pressed against the photosensitive drum 7 as shown in FIG. 28B. After the gear portion is thus engaged, the untoothed gear 134 can receive a rotating force from the core metal 8*a*, to rotate to a position where it is stopped from rotating by the stopper 135, thus returning back to a state for image formation.

Eighth Embodiment

This embodiment is described with reference to a case where the charging roller 8 of the first embodiment is not driven in rotation by the photosensitive drum 7 but is rotated in a direction opposite to that of the seventh embodiment.

In contrast to the seventh embodiment, when the charging roller 8 is rotated in a reverse direction by another driving force transmitting mechanism (not shown), the untoothed gear 134 driven in rotation due to a frictional force received from the core metal 8*a* cannot mesh with the drum gear 139. To guard against this, an idler gear is used.

Figure 29:
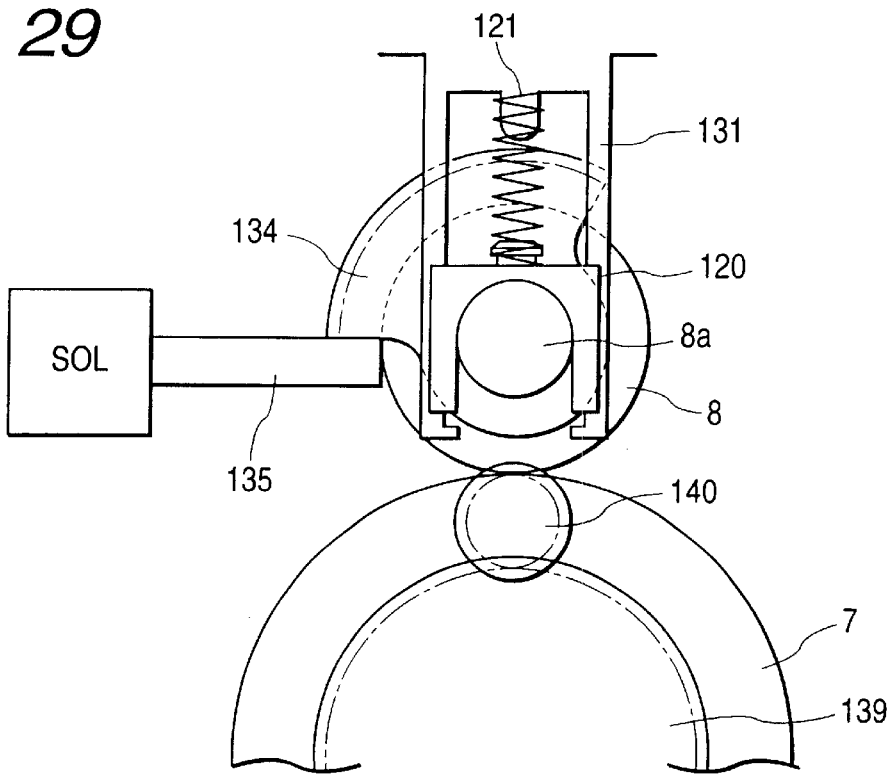
FIG. 29 is an illustration of the charging roller of another embodiment of the invention as viewed from the axis of the photosensitive drum.
Figure 30:
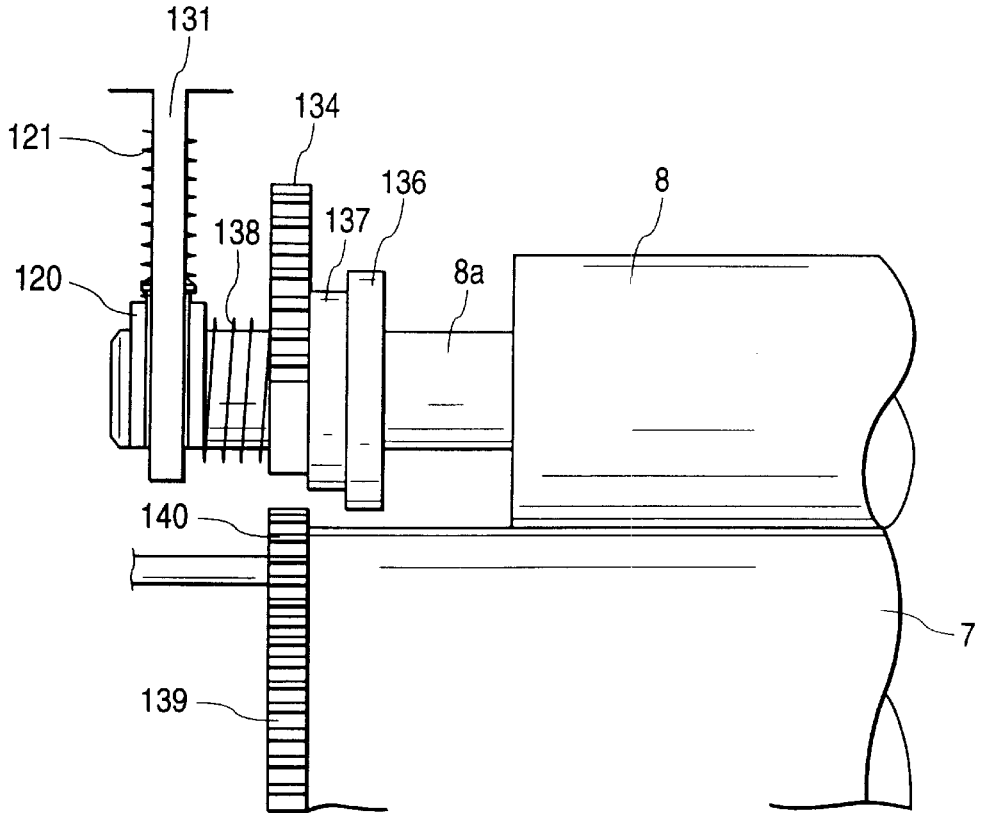
FIG. 30 is a side view with respect to FIG. 29.

FIG. 29 shows the eighth embodiment wherein an idler gear is added to the seventh embodiment. FIG. 30 is a side view with respect to FIG. 29. As shown in both FIGS. 29 and 30, the untoothed gear 134 meshes with no other gears with the charging roller 8 put in contact with the photosensitive drum 7. An idler gear 140 is arranged between the drum gear 139 and the untoothed gear 134. The idler gear 140 rotates in synchronization with the drum gear 139.

Figure 31B:
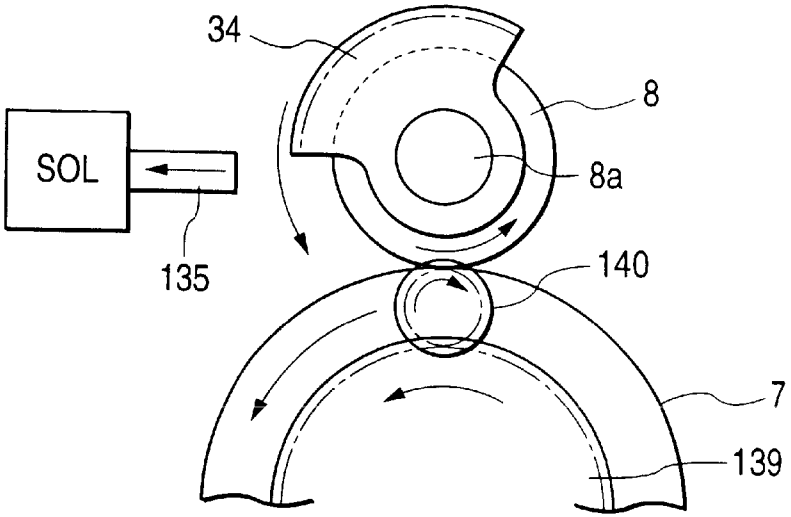
FIGS. 31A and 31B show contacting/separating operations of the charging roller of the embodiment of FIG. 29.
Figure 31A:
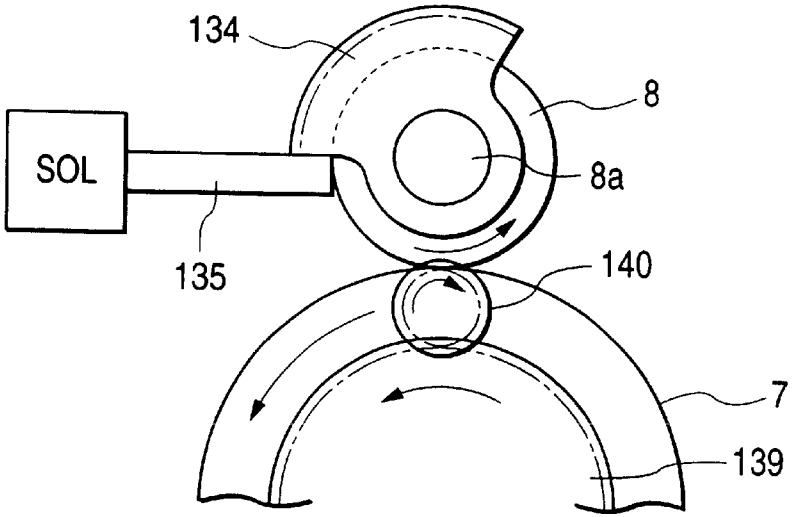

The following will describe an order of contacting/separating operations with reference to FIGS. 31A to 32B. As shown in FIG. 31A, when the photosensitive drum 7 is rotating, the charging roller 8 and its core metal 8*a* also rotate, to transmit a rotating force via the frictional member 137 to the untoothed gear 134. If prevented from rotating by the stopper 135, the untoothed gear 134 stops there. In this state, the untoothed gear 134 and the idler gear 140 do not mesh with each other with the charting roller 8 as pressed against the photosensitive drum 7. This state is maintained as far as the photosensitive drum 7 is rotating for image formation.

Figure 32B:
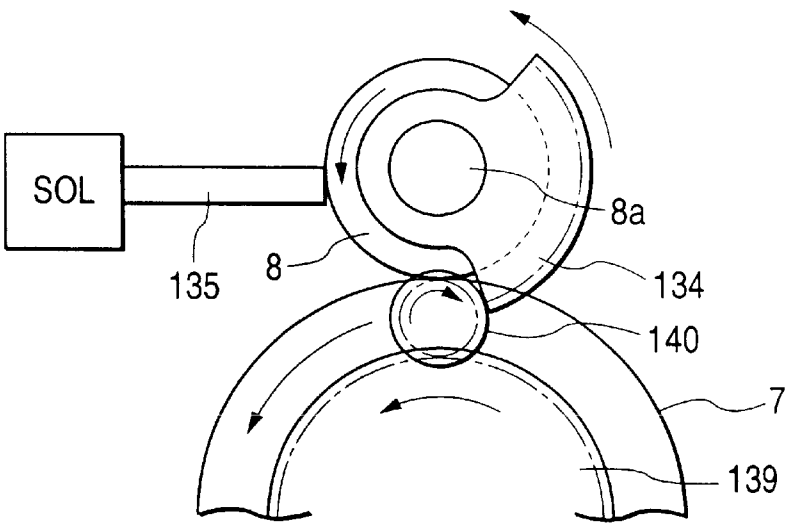
FIGS. 32A and 32B show further contacting/separating operations of the charging roller of the embodiment of FIG. 29.
Figure 32A:
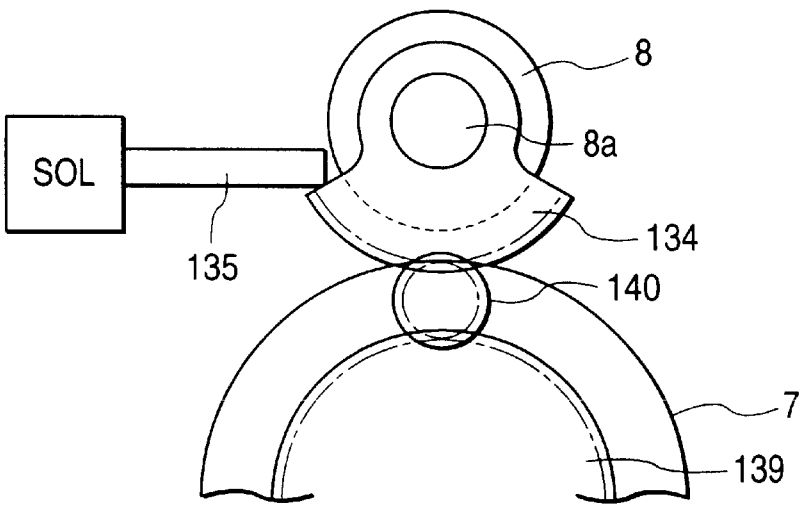

To start separating the charging roller 8, first, as shown in FIG. 31B, the regulation releasing means such as a solenoid or motor is used to cause the stopper 135 to escape from the untoothed gear 134 to a non-contacting position. With this, the untoothed gear 134 is driven in rotation by the core metal 8*a*, to mesh with the idler gear 140. A pitch circle diameter of the idler gear 140 and that of the untoothed gear 134 are determined in such a manner that the charging roller 8 may be separated from the photosensitive drum 7 when the untoothed gear 134 and the idler gear 140 have thus meshed with each other. If the photosensitive drum 7 is stopped from rotating when a constant time lapse has elapsed after the stopper 135 which had regulated the rotation of the untoothed gear 134 was released, the charging roller 8 is maintained as separated from the photosensitive drum 7 as shown in FIG. 32A.

The following will describe a method for returning the charging roller to its state of being pressed against the photosensitive drum 7 in order to form an image again. First, the drum gear 139 is rotated in a state where the untoothed gear 134 is meshing with the idler gear 140. With this, the untoothed gear 134 rotates as driven in rotation by the idler gear 140. When the gear portion is disengaged from the idler gear 140, the charging roller 8 is completely pressed against the photosensitive drum 7 as shown in FIG. 32B. After the gear portion is thus disengaged, the untoothed gear 134 can receive a rotating force from the core metal 8*a*, to rotate to such a position as to be stopped from rotating by the stopper 135, thus returning to an image forming state.

Ninth Embodiment

Figure 33B:
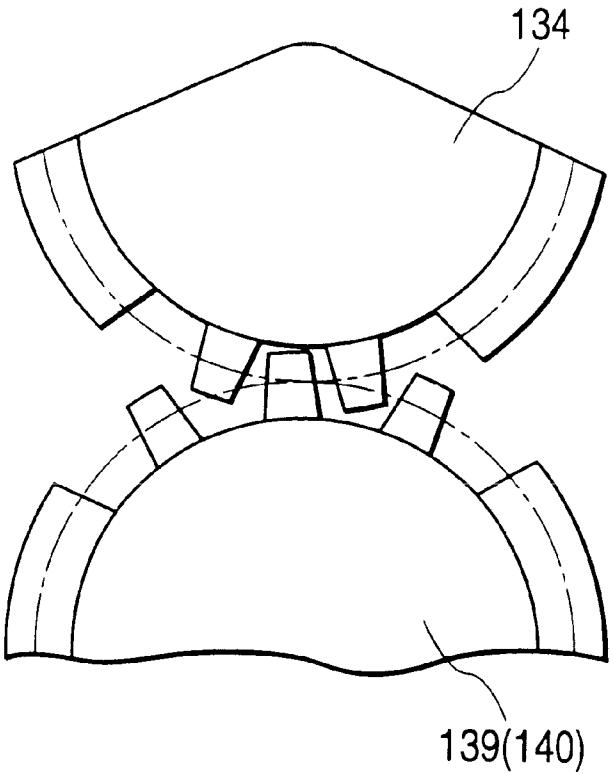
Figure 33A:
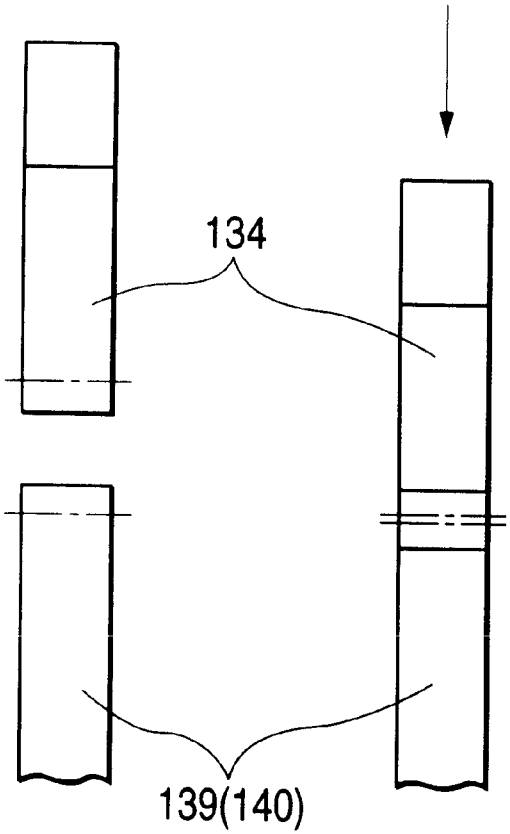

In contrast to the seventh embodiment where the untoothed gear 134 is pressed against the drum gear 139, in a ninth embodiment it is pressed against the idler gear 140. FIG. 33A is a side view of the untoothed gear 134 and another gear meshing therewith. An arrow in the figure indicates a direction of loading. If the untoothed gear 134 receives a load, the gears 134 and 139 (or 14) meshing with each other hit each other at their tooth top and tooth bottom and so cannot obtain normal rotation. FIG. 33B indicates that state as viewed axially.

Figure 34B:
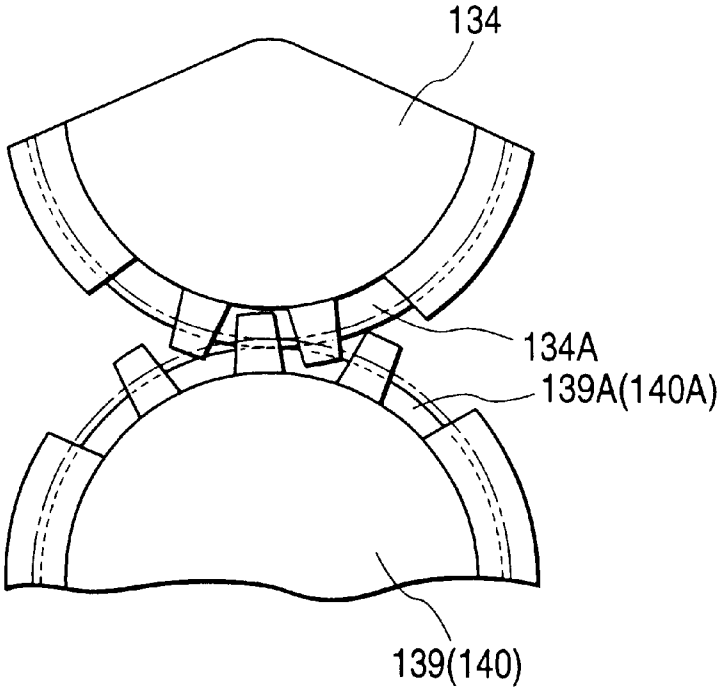
FIGS. 34A and 34B show further another embodiment of the invention.
Figure 34A:
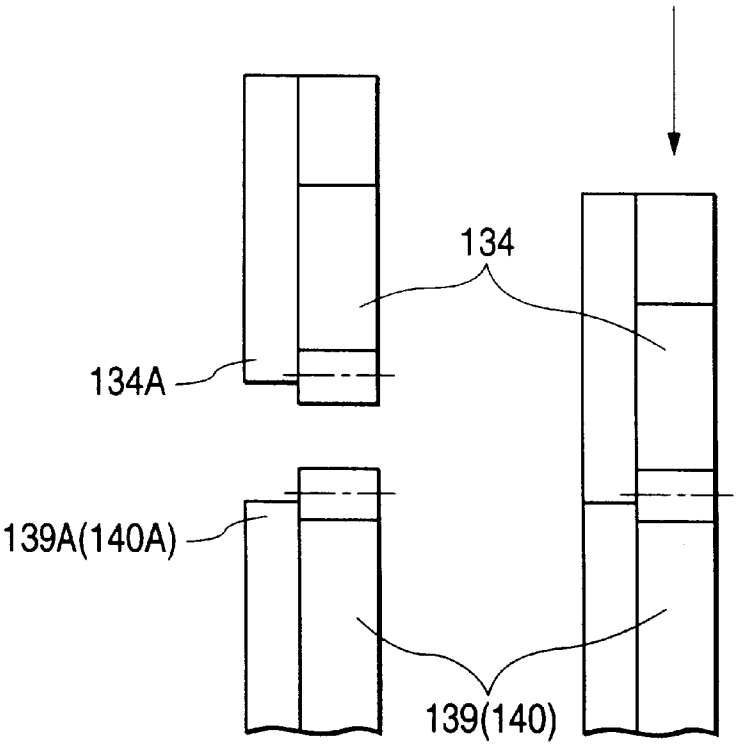

Accordingly, in this embodiment, as shown in FIGS. 34A and 34B, the untoothed gear 134 is mounted with an inter-axial regulating member 134A having almost the same shape as itself. Furthermore, the gear 139 (or 140) meshing with the untoothed gear 134 is mounted with an inter-axial regulating member 139A (or 140A). An arrow in the figure indicates a direction of loading.

By butting the inter-axial regulating members 134A and 139A (or 140A) to each other, the inter-pitch distance can be secured between the untoothed gear 134 and the gear 139 (or 140). The inter-axial regulating member should preferably be used even when the charging roller 8 rotates as driven in rotation by the photosensitive drum or rotates in a reverse direction.

Tenth Embodiment

The charging roller 8 is described as follows. As shown in FIG. 5, the charging roller 8 has such a configuration that the core metal (conductive substrate) 8*a* made of SUS is surrounded by the resistor layer 8*b*. The resistor layer 8*b* consists of the covering layer 8*c* serving as a surface layer and the underlying elastic layer 8*d*. The charging roller 8 is abutted by the biasing member 21 such as a coil spring via the bearing 20 made of a conductive member against the photosensitive drum 7, to configure an electric circuit. The charging roller 8 is supplied with a charging bias via the bearing 20 from a power source not shown, thus charging the photosensitive drum 7 via its nip portion 22 with the photosensitive drum 7. The photosensitive drum 7 is uniformly charged thereon as it moves in an L direction.

Note here that the invention constructs special stopper means to configure a contacting/separating mechanism without using an electric component such as a solenoid, thus making it possible to touch the process means such as a charging roller to and separate it from the photosensitive drum without rotating the photosensitive drum in a reverse direction.

Figure 35:
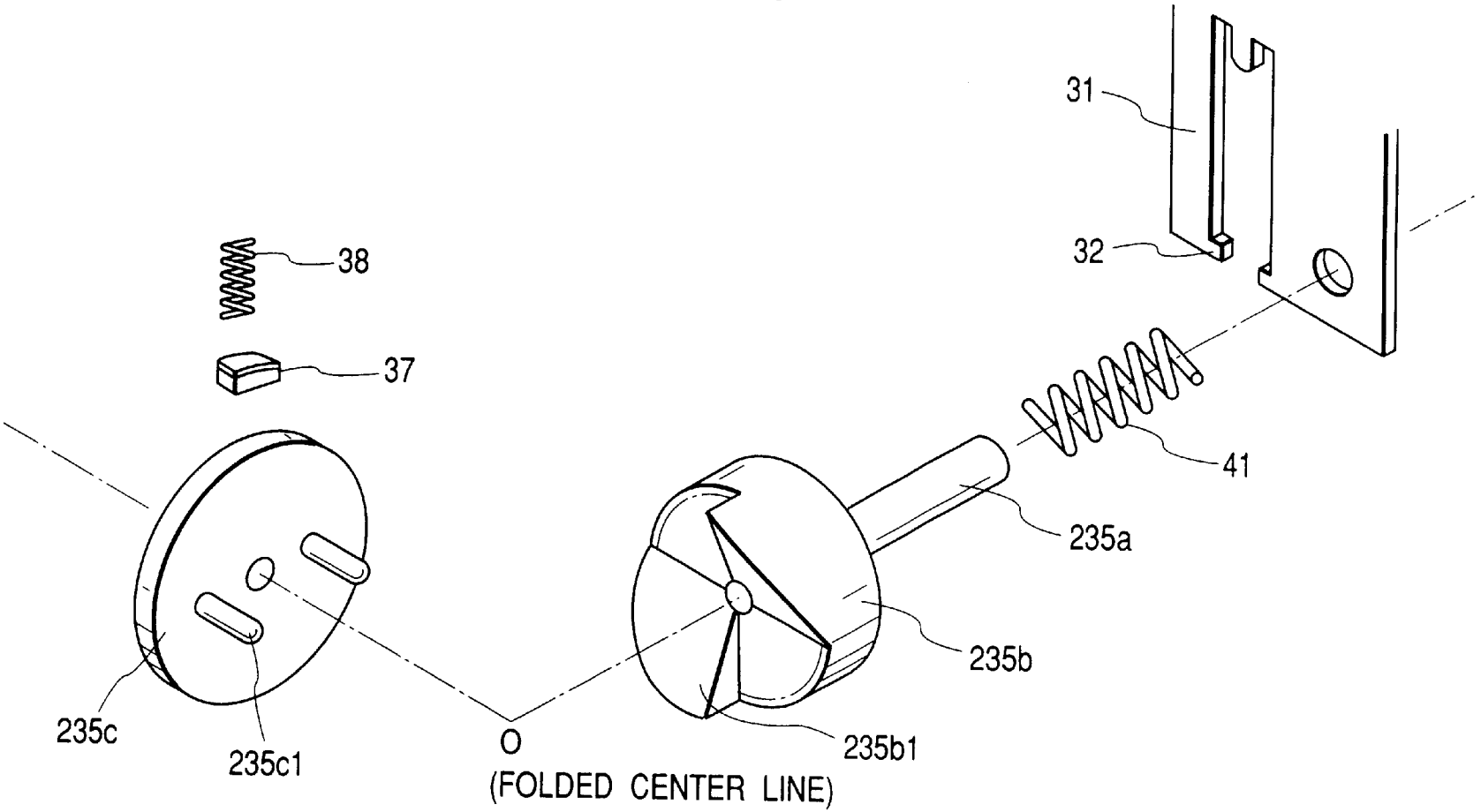
FIG. 35 is a layout of components of the stopper means of the invention.

First, the stopper means constructed in the invention is described. FIG. 35 is an exploded view showing the stopper means related to the invention. There are shown the bearing portion 31 and those components for moving a stopper portion 35*a*.

A stopper driving gear 235*b* meshes with the drum gear 39 (see FIGS. 41A and 41B), to receive a rotary driving force. The stopper portion 235*a* and the stopper driving gear 235*b* are integrated into one piece. The stopper driving gear 235*b* and the rotating member 235*c* are both rotated as supported by a fixed axis (not shown). The stopper driving gear 235*b* and the rotating body 235*c* utilize a drag generated at a contact portion therebetween, to give rise to a thrust force, thus transmitting power. One example is such that a single of or a plurality of protrusion 235*c*1 is mounted to the rotating member 235*c*. A side 235*b*1 of the stopper driving gear 235*b* which comes in contact with this protrusion 235*c*1 is tapered off. In this case, to generate a drag at the taper portion, a load must be imposed on the side to which power is transmitted, so that the frictional member 37 is energized by a compressive coil spring 238.

Figure 36A:
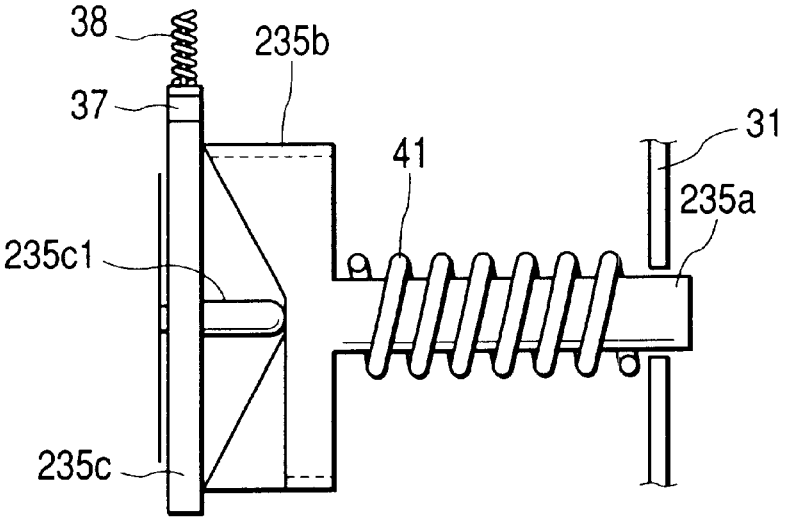
FIGS. 36A and 36B show operations of the stopper means.
Figure 36B:
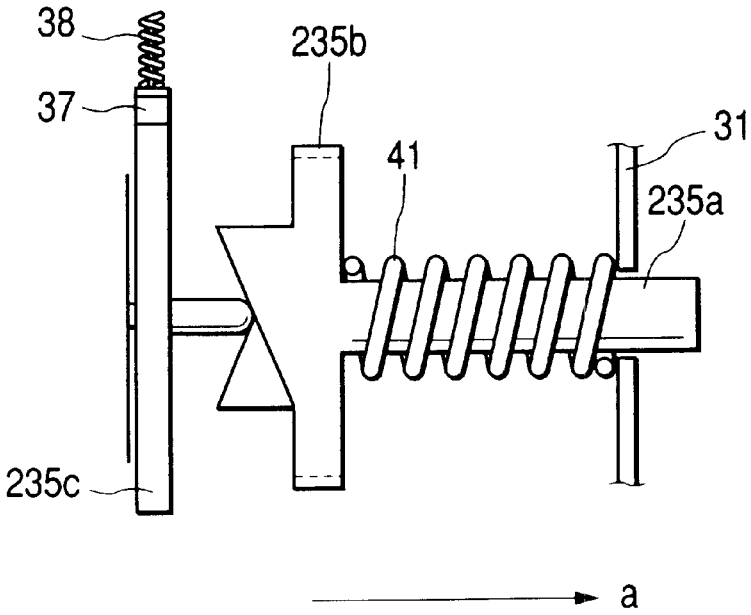

The following will describe a series of operations of this stopper member 235 with reference to FIGS. 36A to 37B. FIG. 36A indicates a state where the photosensitive drum is stopped. As shown in FIG. 36B, when the stopper driving gear 235*b* rotates, a taper surface 235*b*1 presses the protrusion 235*c*1, to generate a drag, an axial component force of which permits the stopper portion 235*a* to slide in an arrow a direction to the extreme end.

Figure 37A:
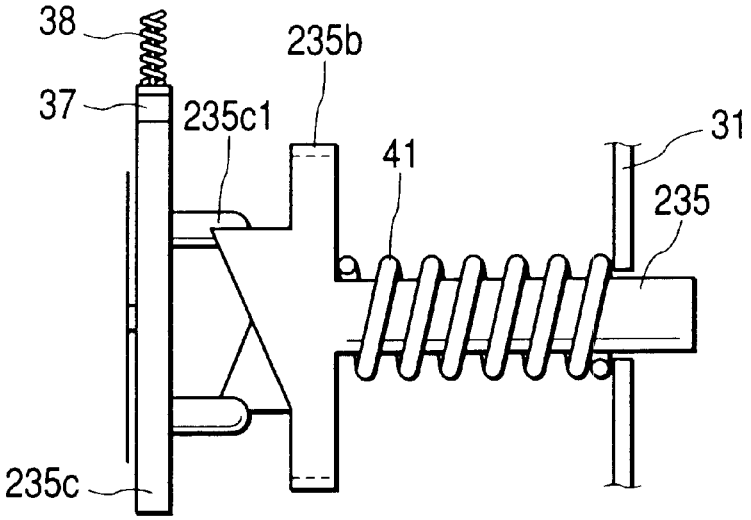
FIGS. 37A and 37B show further operations of the stopper means.
Figure 37B:
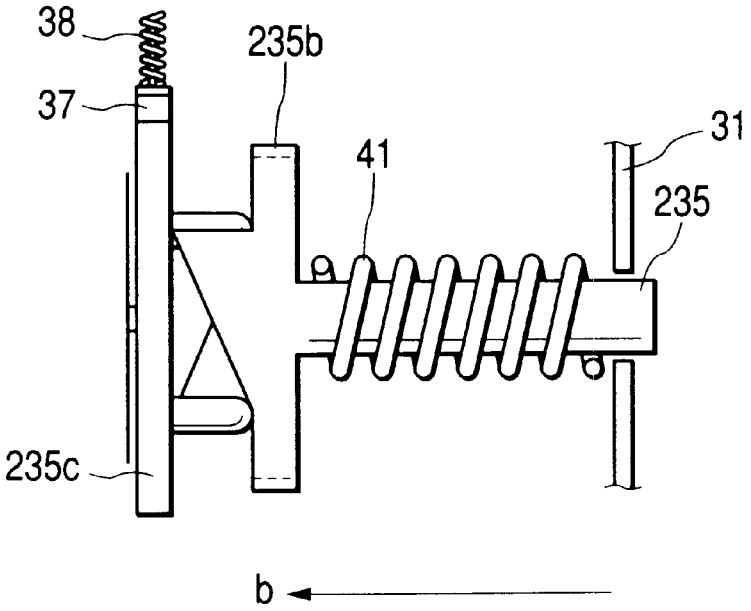

When the drum gear 39 stops rotating, the stopper driving gear 235*b* also stops simultaneously (FIG. 37A). The rotating member 235*c* stops after it has rotated until it enters a state shown in FIG. 36A or it loses an inertia force. Rotation due to this inertia force eliminates the drag at the protrusion portion. When a force in the a direction is thus eliminated, as shown in FIG. 37B, the stopper portion 235*a* receives an arrow b directional force generated by the compressive coil spring 41, thus sliding in the b direction.

Figure 38:
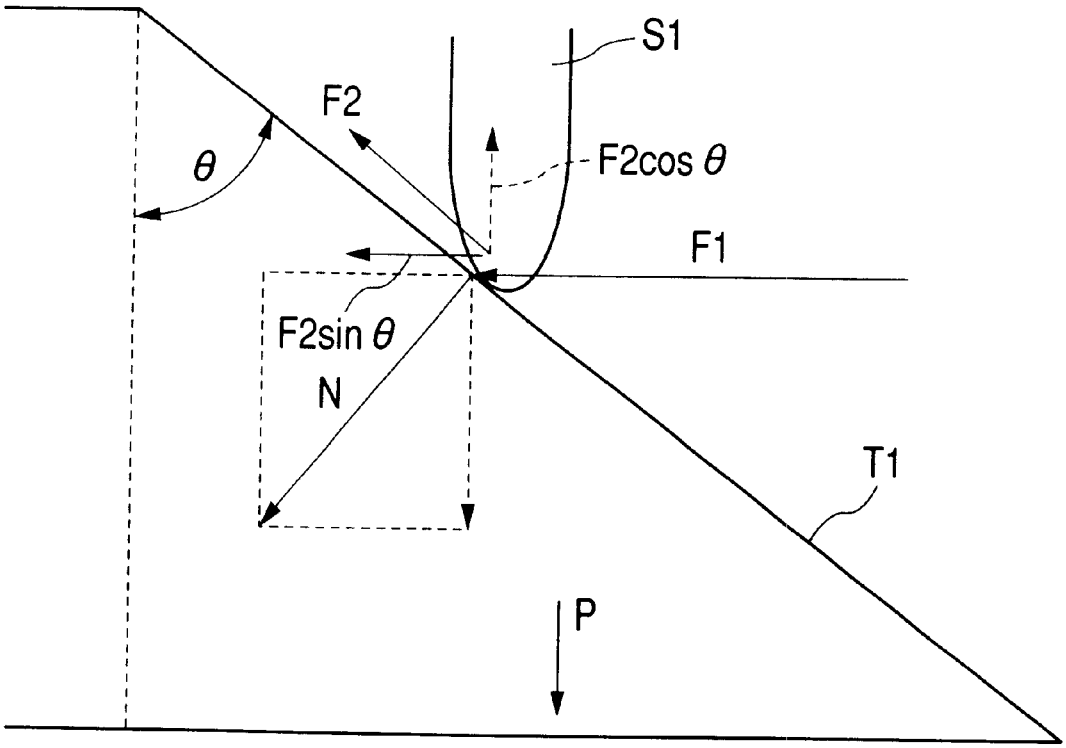
FIG. 38 shows a thrust force generated at the stopper.

The thrust force given to the stopper member is described with reference to FIG. 38. In FIG. 38, if there is no drag generated at contact portion between a sliding stopper member S1 and a taper portion T1 of the rotating member, an axial force P does no act on the stopper. A drag being generated means that the side receiving a force has a load (i.e., difficulty to be rotated). If there is a load imposed, the photosensitive drum is difficult to rotate due to an inertia force generated after it is stopped. If an amount of rotation due to an inertia force is small, an amount of returning of the stopper (stroke) is also small.

The following will describe the relationship between the axial force and the rotation due to an inertia force. As shown in FIG. 38, supposing a circumferential (rotational) force imposed on a contact portion of the taper portion T1 to be F1 and a friction coefficient at the contact portion to be $\mu$, an axial force P converted by the taper portion is as follows:

$$P=N\sin\theta-\mu N\cos\theta,\ F1=N\cos\theta+\mu N\sin\theta$$

Accordingly, $\therefore P=F1\times(\tan\theta-\mu)/(1+\mu\tan\theta)$ is satisfied.

Next, supposing a radius of the rotating member 235*c* to be R, its mass to be M, and its number of revolutions to be $\omega$, its rotation energy W can be given as follows using its inertia moment $I=\frac{1}{2}\times R^2$: $W=\frac{1}{2}\times I\omega^2$ An amount of rotation generated by this rotation energy until this energy is consumed by the above-mentioned force F1 gives the amount of rotation due to the inertia force. It is necessary to accumulate rotation energy enough to reserve a necessary stroke. This principle causes the stopper portion 35*a*, during continuous rotation of the drum gear 39, to slide in an arrow a direction and, when it stops, to slide in an arrow b direction up to its original position.

Figure 39:
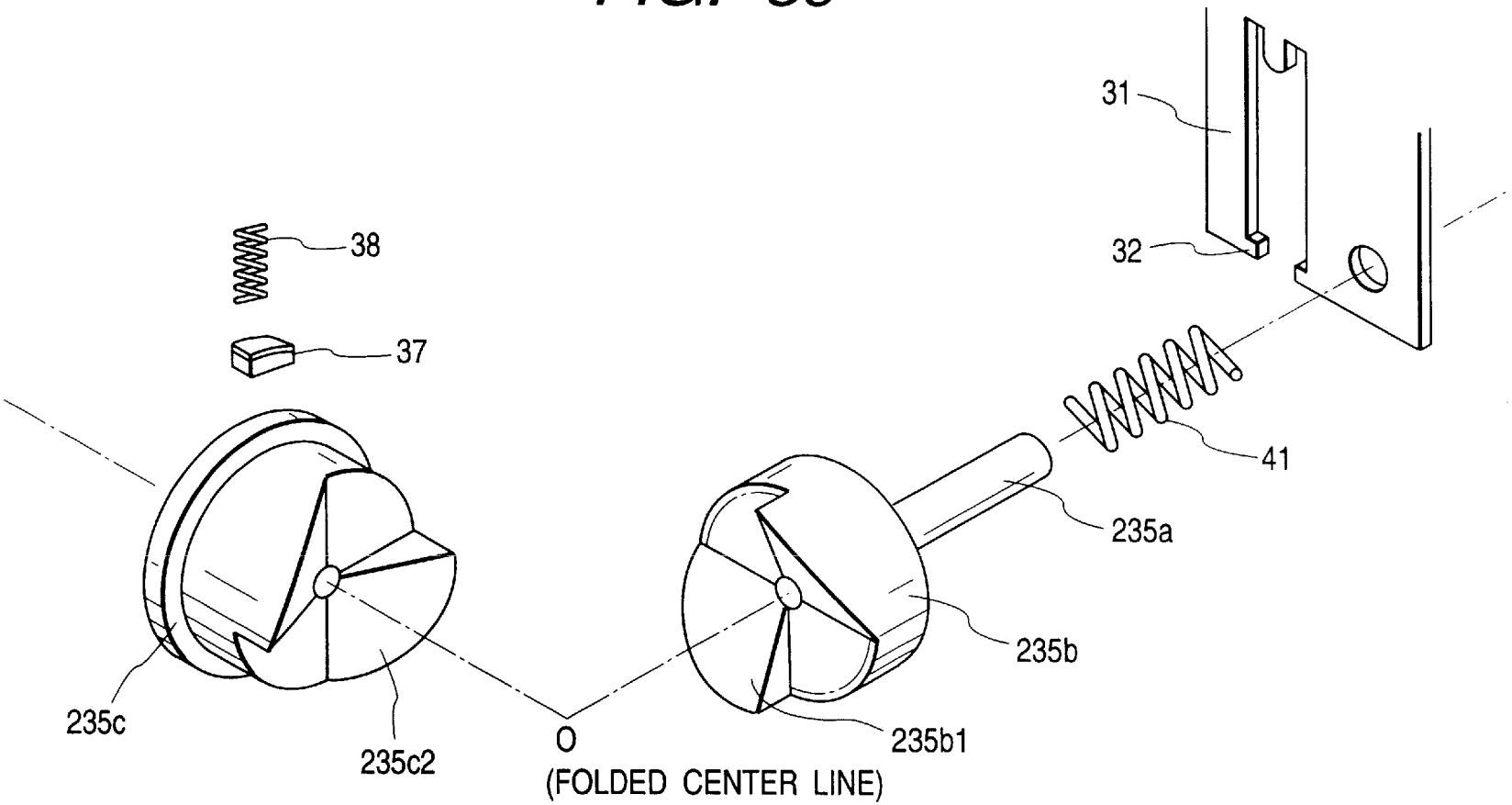
FIG. 39 shows a variation of the stopper means.

If both the rotating member 235*c* and the stopper driving gear 235*b* are provided with taper shapes 235*c*2 and 235*b*1 respectively as shown in FIG. 39, the same actions can be obtained.

Figure 40:
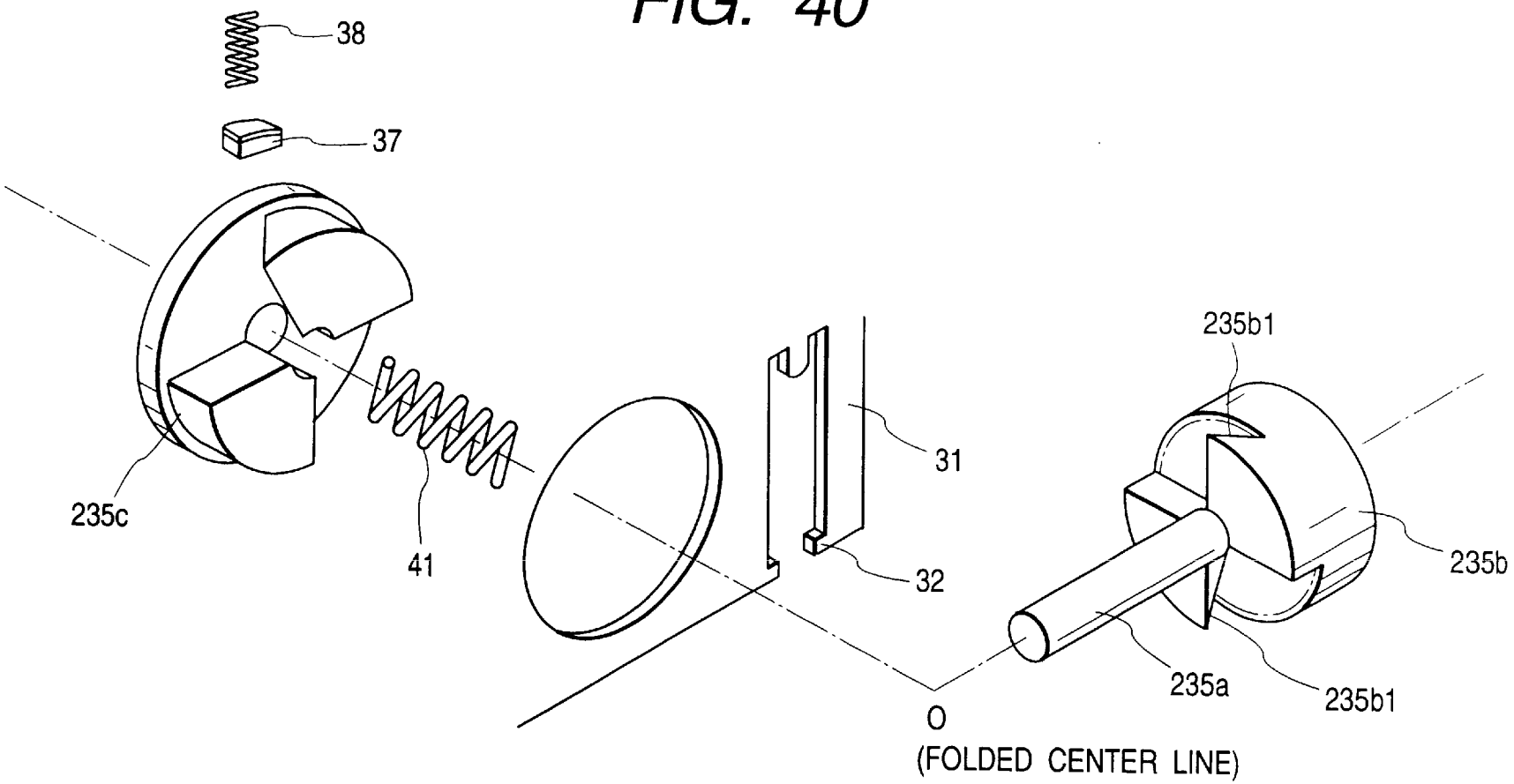
FIG. 40 shows another variation of the stopper means.
Figure 41A:
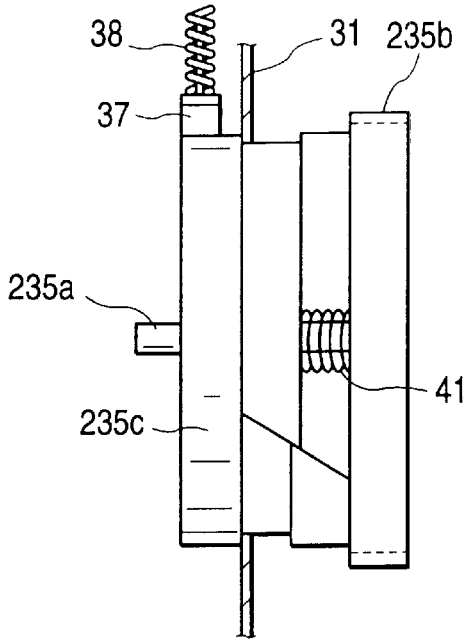
FIGS. 41A and 41B are cross-sectional views of the stopper of FIG. 40.
Figure 41B:
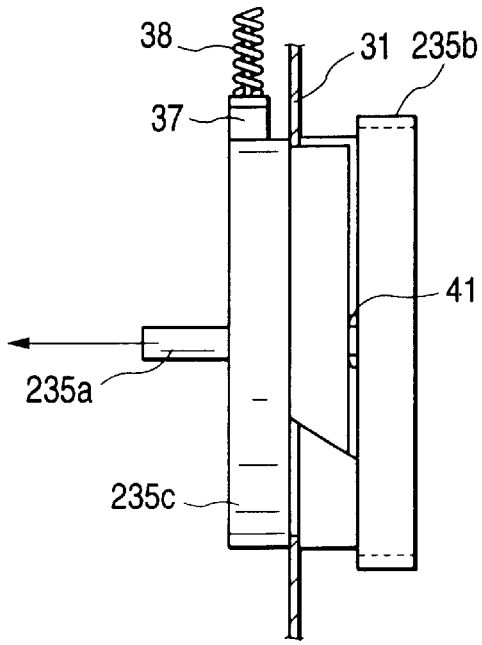

FIG. 40 shows a perspective view where components generating a drag are provided with a taper shape so that they may attract each other by an action of a thrust force generated when they are driven in rotation, and FIGS. 41A and 41B are relevant side views.

FIG. 40 indicates a state before the components are assembled. FIG. 41A indicates a state where they are assembled along a centerline. FIG. 41B indicates a state where they attract each other due to a thrust force they received when they are driven in rotation, thus having moved the stopper portion 235*a*. The operating principle causes the thrust force generated at the taper portion to act in a direction opposite to that with the above-mentioned mechanism.

The invention configures a contacting/separating mechanism for the process means by utilizing such stopper means that provides different positions of the stopper portion 235*a* when the above-mentioned photosensitive drum 7 is rotating and is stopped.

In the present embodiment, a method of separating the process means using the untoothed gear is described. Here, the charging roller is described as an example of the process means.

Figure 42:
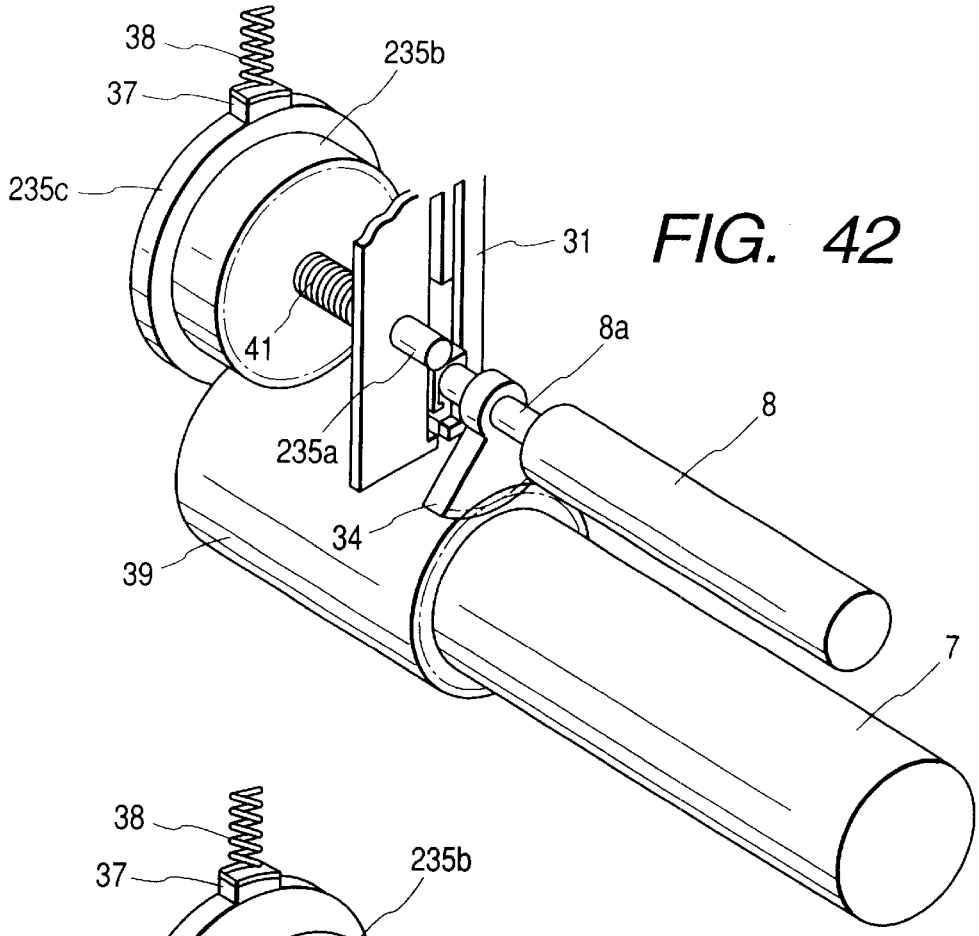
FIG. 42 shows a contacting/separating mechanism configured using the stopper means of the invention.

FIG. 42 shows a peripheral of a control portion of the contacting/separating mechanism for the process means of the process cartridge B of this embodiment.

An inter-axial distance when the untoothed gear 34 is meshing with the drum gear 39 is arranged to be larger than that when the charging roller 8 is pressed against the photosensitive drum 7. FIG. 42 indicates a state where the untoothed gear 34 meshes with the drum gear 39, to separate the charging roller 8 from the photosensitive drum 7.

When the drum gear 39 receives a driving force from the main body of the image forming apparatus, the photosensitive drum 7 and the stopper driving gear 235*b* meshing with the drum gear 39 rotate. Furthermore, the charging roller 8 and its core metal 8*a* rotate as driven in rotation by the rotating photosensitive drum 7 or by any other driving source. The untoothed gear 34 fitted to the core metal 8*a* receives a frictional force from the core metal 8*a*, to use it as a driving force.

Figure 43:
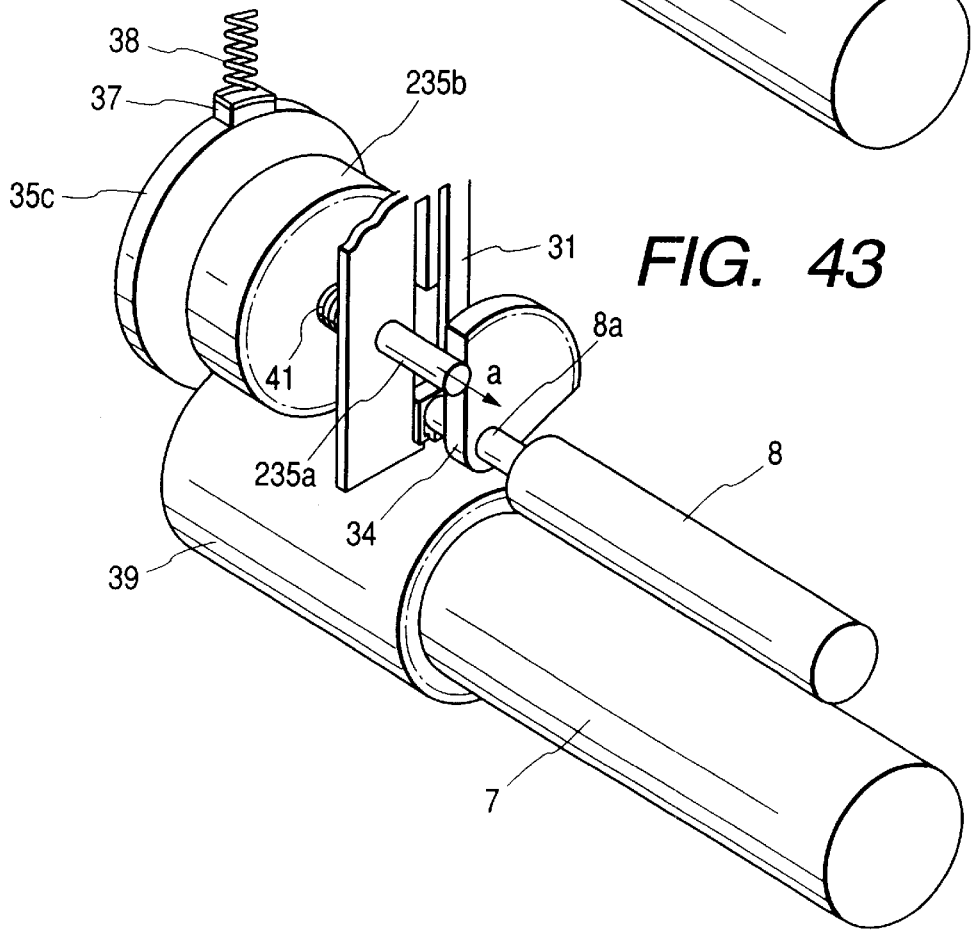
FIG. 43 shows operations of the contacting/separating mechanism of FIG. 42.

FIG. 43 indicates a state when an image is formed. When the drum gear 39 is rotating, the stopper 235*a* slides in an arrow a direction in the figure and enters a rotation plane of the untoothed gear 34, thus stopping it from rotating. This state is maintained as far as the drum gear 39 continues to rotate. In this state, the untoothed gear 34 cannot mesh with the drum gear 39. That is, there is no member for regulating the inter-axial distance between the charging roller 8 and the photosensitive drum 7, the charging roller 8 is pressed against the photosensitive drum 7 by a force of the biasing member 21 shown in FIG. 5. In this state, an image is formed.

The following will describe an order of operations of separating the charging roller 8. The separating operations are completed by once stopping the drum gear 39 from rotating after image formation and then rotating it again by a constant angle.

Figure 44:
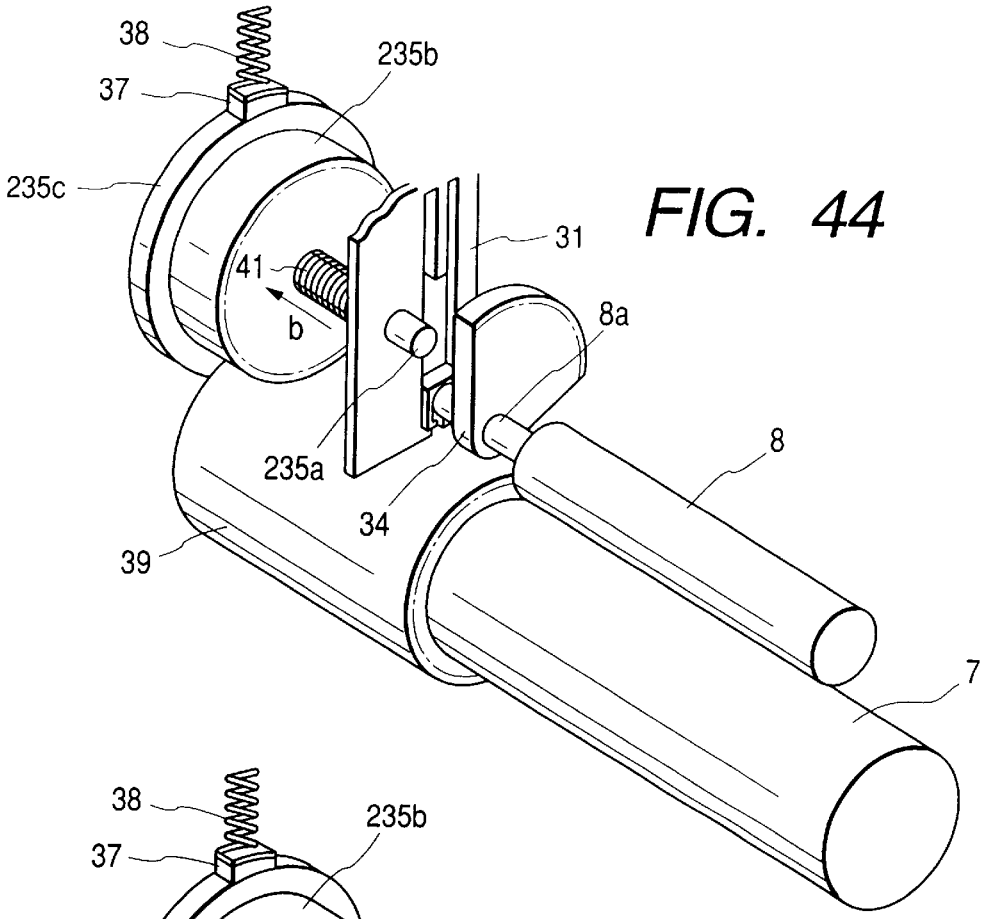
FIG. 44 shows operations of the contacting/separating mechanism.

FIG. 44 indicates a state immediately after the drum gear 39 is stopped after the completion of the image formation. First, when the drum gear 39 is stopped from rotating, the stopper 235*a* slides in an arrow b direction in the figure. In this state, the untoothed gear 34 is relieved of rotation regulation. The untoothed gear 34, however, stays at a position when the drum gear 39 is stopped so does not mesh with the drum gear 39 yet. That is, the charging roller 8 remains as pressed against the photosensitive drum 7.

Figure 45:
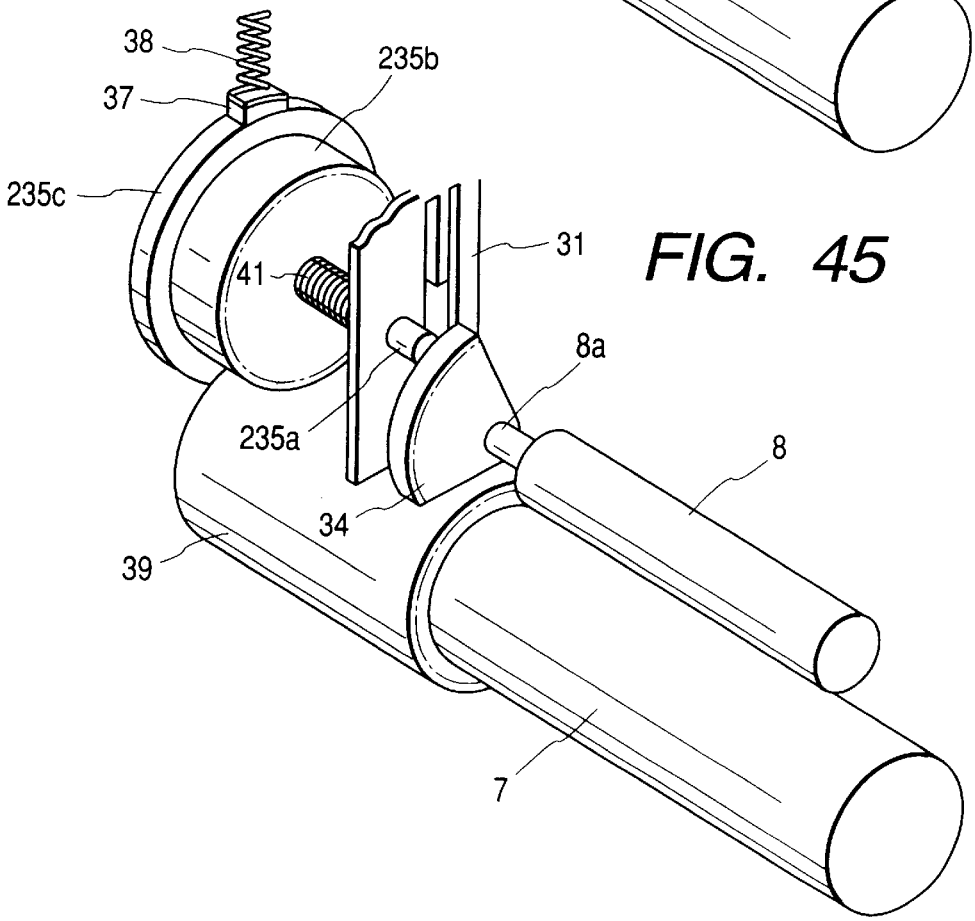
FIG. 45 shows further operations of the contacting/separating mechanism.

FIG. 45 indicates a state where the drum gear 39 is rotated again in order to separate the charging roller 8. In this state, the stopper 235*a* slides again into the rotating plane of the untoothed gear 34 but the untoothed gear 34 also starts rotating at the same time as the drum gear 39 starts rotating, so that the untoothed gear 34 cannot be stopped from rotating. The drum gear 39 is stopped when the untoothed gear 34 starts rotating and meshes with the drum gear 39, to cause the drum gear 39 to rotate by such an angle as to take the charging roller 8 to a complete separation position.

When the drum gear 39 is thus stopped, return is made to a state shown in FIG. 42 where the charging roller 8 is separated.

Eleventh Embodiment

Figure 46:
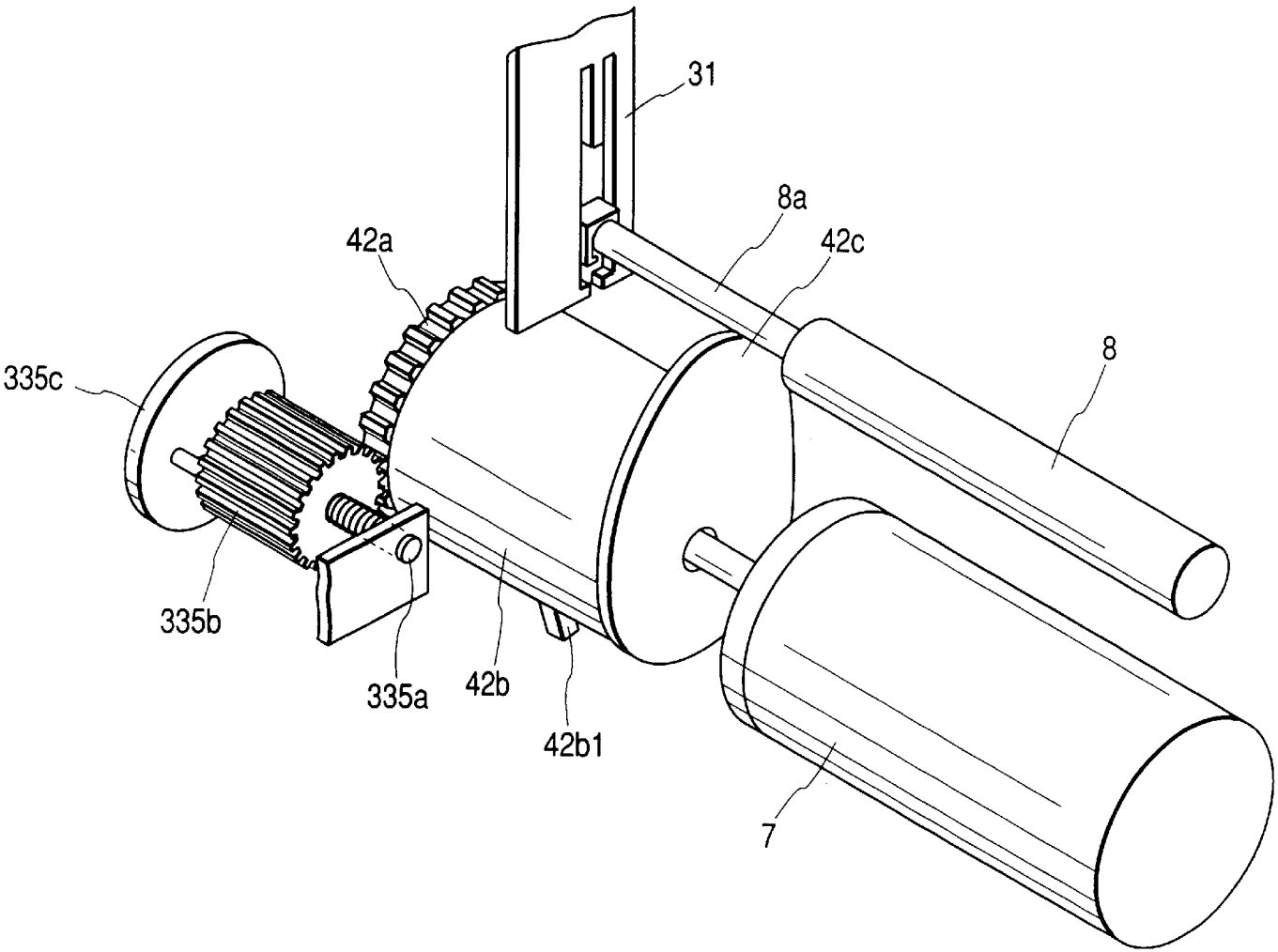
FIG. 46 shows another example of the contacting/separating mechanism configured using the stopper means of the invention.

FIG. 46 shows a peripheral of the charging roller contacting/separating mechanism of the process cartridge B of another embodiment of the invention. In this embodiment, on the same axis as the photosensitive drum 7 is arranged the spring clutch comprising the input gear 42*a*, the control portion 42*b*, and the cam 42*c*.

FIG. 46 indicates a state where the charging roller 8 is separated from the photosensitive drum 7. The input gear 42*a* of the spring clutch 42 is fixed to the axis of the photosensitive drum 7. The spring clutch output portion is cam-shaped, to use the cam 42*c*, in order to lift up the charging roller's core metal 8*a*, thus separating it from the photosensitive drum 7.

Figure 47:
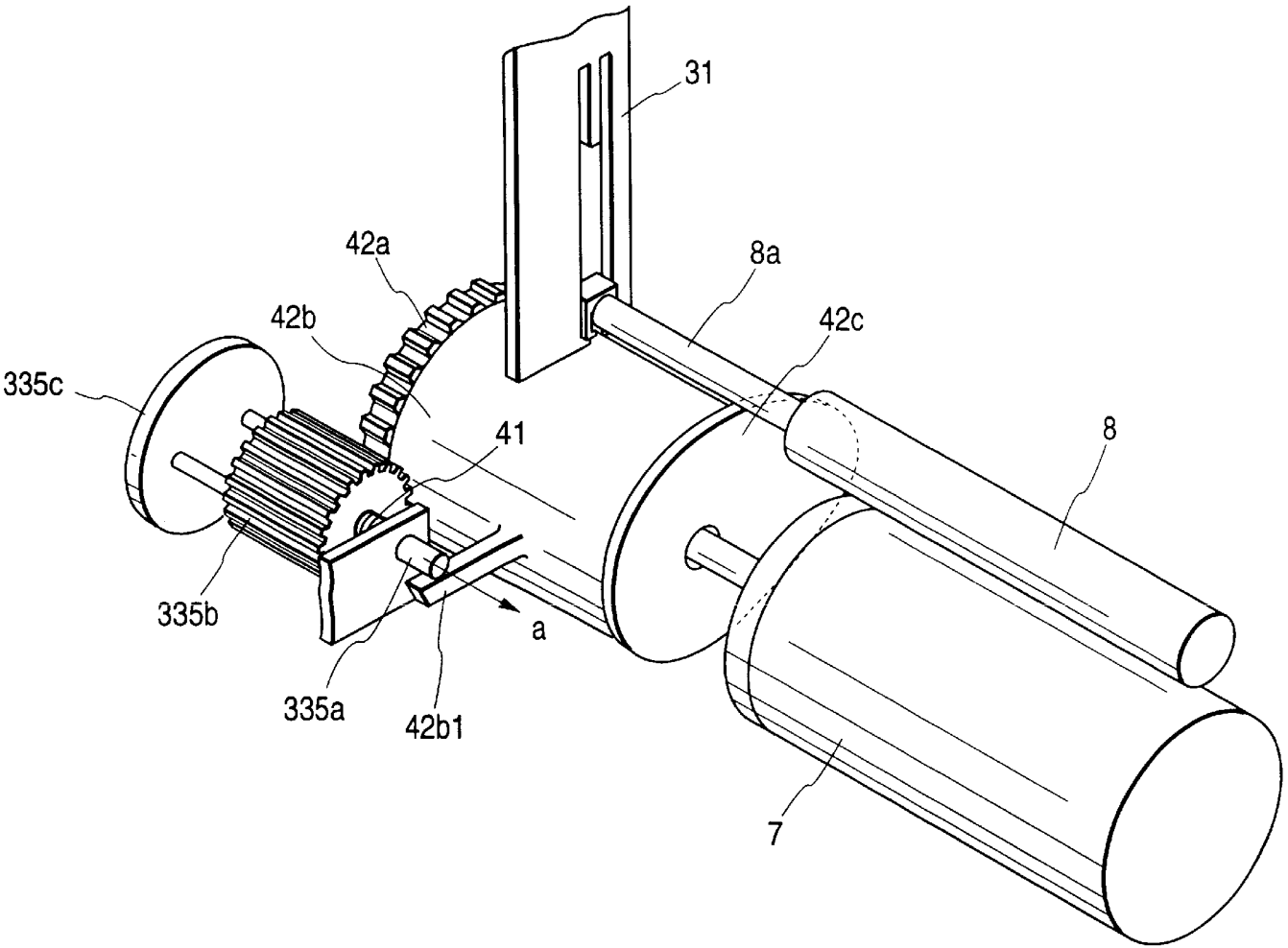
FIG. 47 shows operations of the contacting/separating mechanism of FIG. 46.

FIG. 47 indicates a state where the cam 42*c* is stopped at a position where it does not come in contact with the charging roller's core metal 8*a*. When the spring clutch is transmitting a driving force, the input gear 42*a*, the spring clutch control portion 42*b*, and the cam 42*c* rotate simultaneously. When they start rotating, a stopper portion 335*a* slides in an arrow a direction. The spring clutch control portion 42*b* is provided with the protrusion 42*b*1, which is abutted by the above-mentioned stopper portion 35*a* to thereby stops rotation, whereupon the driving force transmission by the spring clutch 42 is suspended to stop the cam 42*c* from rotating there.

The following will describe an order of operations of separating the charging roller 8 from the photosensitive drum 7. When an image is formed, i.e. when the photosensitive drum 7 is continuously rotating, the stopper portion 35*a* slides in the a direction to the extreme end. At this extreme end position, the protrusion of the spring clutch control portion 42*b* is stopped from rotating. Since the position where the cam 42*c* stops is determined by its phase with respect to the protrusion, it always stops at the same position.

Figure 48:
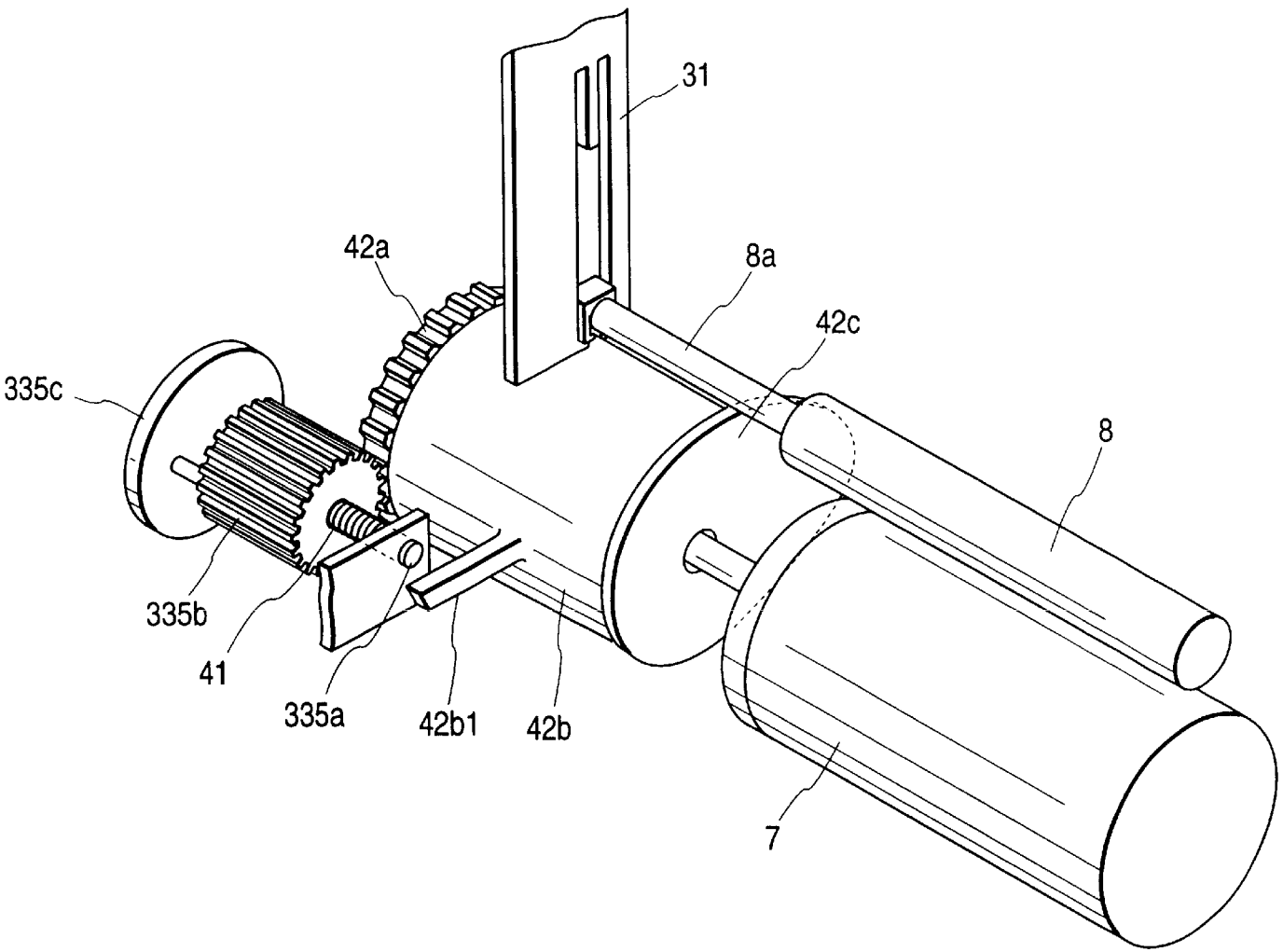
FIG. 48 shows further operations of the contacting/separating mechanism.

FIG. 48 indicates a state immediately after the rotation is once stopped after image formation. In this state, like in the case of the tenth embodiment, the stopper portion 335*a* slides in the b direction due to a force of the compressive coil spring 41. With this, the clutch's protrusion 42*b*1 is relieved of any rotation regulation.

Figure 49:
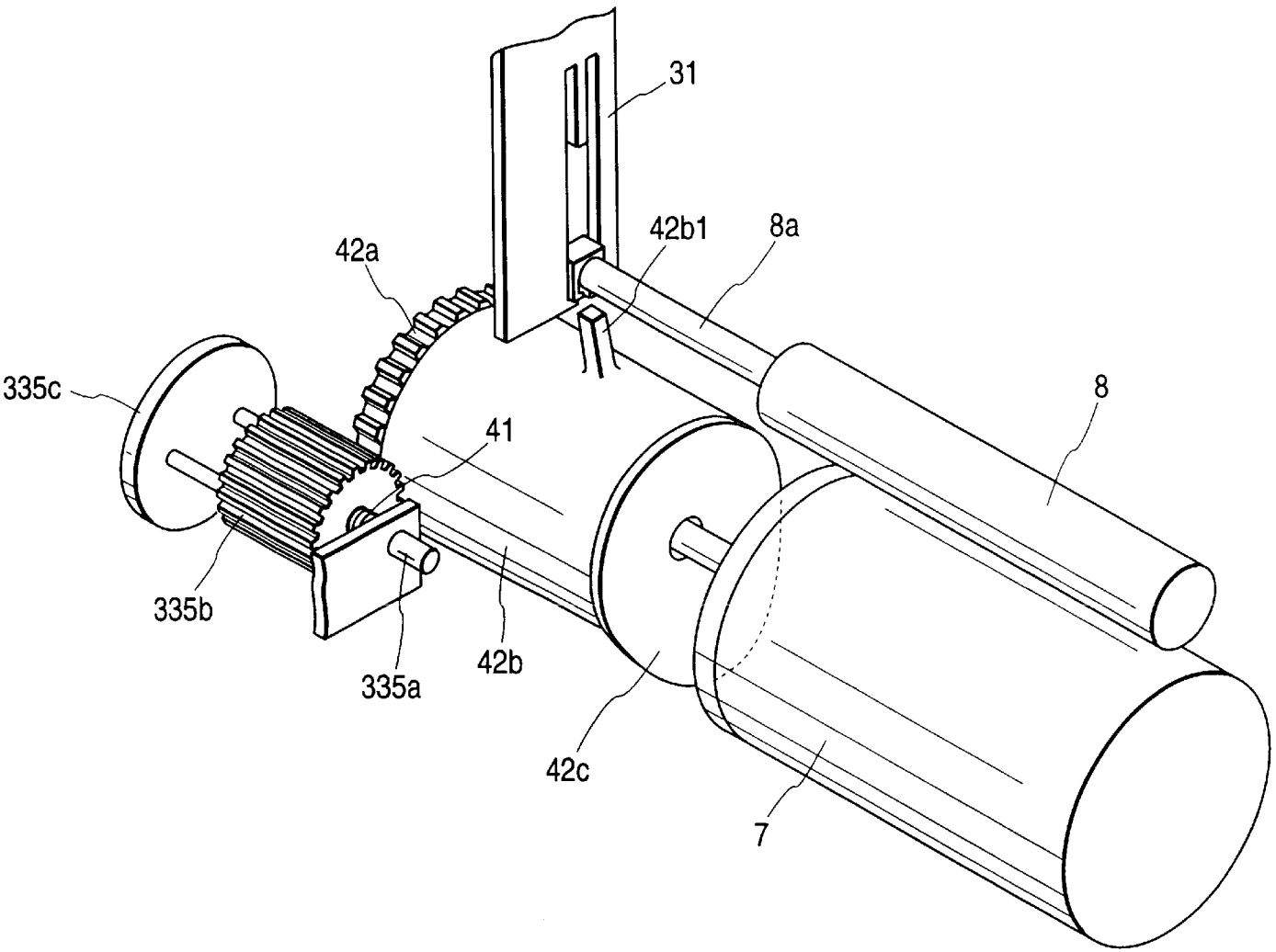
FIG. 49 shows further operations of the contacting/separating mechanism.

FIG. 49 indicates a state where the input gear 42*a* is rotated again, to rotate the cam 42*c*. Since the position where the cam 42*c* stayed can be calculated from its phase with respect to the spring clutch's protrusion, an amount of rotation in this case is such as to take the cam to a position where it can separate the charging roller 8 from the photosensitive drum 7. By stopping the input gear 42*a* from rotating at this position, the separation state can be maintained (to make return to the state of FIG. 46).

Although the embodiments of the invention have been described, the invention is not limited to them but any variations are possible within the scope of the invention.

What is claimed is:

1. A charging apparatus for charging a moving body to be charged, comprising:

a charging member for coming in contact with said body to be charged to charge said body to be charged; and contacting/separating means for contacting said charging member with and separating said charging member from said body to be charged, wherein said contacting/separating means converts a moving force of said body to be charged into a force for contacting/separating said charging member, wherein said contacting/separating means includes a thrust force generating member for generating a trust force by engaging with a gear provided to said body to be charged, and a stopper member, provided integrally with said thrust force generating member, for regulating said cam member.

2. A charging apparatus according to claim 1, wherein said contacting/separating means converts, into the force for contacting/separating said charging member, a moving force in a direction in which said body to be charged moves during a charging period.

3. A charging apparatus according to claim 2, wherein the conversion into the force for contacting/separating is performed during a non-charging period.

4. A charging apparatus according to claim 1, where said contacting/separating means receives a driving force from said body to be charged and has a cam member fixed to an axis of said charging member.

5. A charging apparatus according to claim 1, wherein said charging apparatus is used in an electrophotographic type image forming apparatus, and said body to be charged has a photosensitive layer.

6. A process cartridge detachably attachable to an image forming apparatus, comprising:

a photosensitive body;

a process member, pressure-contacting with said photosensitive body, for acting on said photosensitive body; and contacting/separating means for contacting said process member with and separating said process member from said photosensitive body;

wherein said contacting/separating means converts a moving force of said photosensitive body into a force for contacting/separating said process member, wherein said contacting/separating means includes a thrust force generating member for generating a trust force by engaging with a gear provided to said photosensitive body, and a stopper member, provided integrally with said thrust force generating member, for regulating said cam member.

7. A process cartridge according to claim 6, wherein said contacting/separating means converts, into a force for contacting/separating of said process member, a moving force in a direction in which the photosensitive body moves when an image is formed.

8. A process cartridge according to claim 7, wherein the conversion into the force for contacting/separating is performed when no image is being formed.

9. A process cartridge according to claim 6, wherein said contacting/separating means receives a driving force from said photosensitive body and has a cam member fixed to said process member.

10. A process cartridge according to claim 6, wherein said process member is a charging member for charging said photosensitive body.

11. A process cartridge according to claim 6, wherein said process member is a developing roll for developing an electrostatic image on said photosensitive body.

12. A charging apparatus for charging a rotatable body to be charged, comprising:

a charging member, which is capable of being in contact with said body to be charged, for charging said body to be charged;

a contacting/separating member for contacting said body to be charged with and separating said body to be charged from said charging member; and a thrust generating member for generating a thrust force by use of a rotation force of said body to be charged;

wherein a contacting/separating motion effected by said contacting/separating member is controlled by use of the thrust force generated by said thrust generating member.

13. A charging apparatus according to claim 12, further comprising a stopper portion moving in a thrust direction by the thrust force, wherein the contacting/separating motion effected by said contacting/separating member is controlled by said stopper portion.

14. A charging apparatus according to claim 13, wherein a position of said contacting/separating member in a rotation direction is regulated in accordance with a position of said stopper portion in the thrust direction, and the contacting/separating motion effected by said contacting/separating member is controlled in accordance with the position of said contacting/separating member in the rotation direction.

15. A charging apparatus according to claim 12, wherein said thrust generating member is provided by engaging with a gear which is provided on said body to be charged or a gear which is rotated while synchronized with a rotation of said body to be charged.

16. A charging apparatus according to claim 12, further comprising a rotary member engaged with said thrust generating member, wherein the thrust force generated by an inertial force of said rotary member, which is generated when a rotation of said body to be charged is stopped, has a direction opposite to the thrust force, which is generated when the rotation of said body to be charged is started.

17. A charging apparatus according to claim 16, wherein said thrust generating member has a second taper shaped portion for generating a thrust force in a second direction opposite to the first direction when the rotation of said body to be charged is stopped.

18. A charging apparatus according to claim 12, wherein said thrust generating member includes one of a twisted polygon hole and a twisted projection to be engaged with the hole.

19. A charging apparatus according to claim 16, wherein an engaging portion between said thrust generating member and said rotary member includes a twisted polygon hole and a twisted projection to be engaged with the hole.

20. A charging apparatus according to claim 12, wherein said thrust generating member is a helical gear.

21. A charging apparatus according to claim 12, wherein said contacting/separating member includes a cam shape.

22. A charging apparatus according to claim 12, wherein said contacting/separating member is a gear in which a portion in a rotation direction of said contacting/separating member is cut away.

23. A charging apparatus according to claim 12, further comprising an elastic member for biasing in a direction opposite to a direction of the thrust force generated when a rotation of said body to be charged is started.

24. A charging apparatus according to claim 13, further comprising an elastic member for biasing in a direction opposite to a direction of the thrust force generated when a rotation of said body to be charged is started, wherein when the rotation of said body to be charged is started, said stopper portion moves in a direction opposite to a direction when the rotation of said body to be charged is stopped.

25. A process cartridge detachably attachable to a main body of an image forming apparatus, comprising:

a rotatable body to be charged, said body to be charged is a photosensitive body;

a charging member, which is capable of being in contact with said body to be charged, for charging said body to be charged;

a contacting/separating member for contacting said body to be charged with and separating said body to be charged from said charging member; and a thrust generating member for generating a thrust force by use of a rotation force of said body to be charged;

wherein a contacting/separating motion effected by said contacting/separating member is controlled by use of the thrust force generated by said thrust generating member.

26. A charging apparatus according to claim 25, further comprising a stopper portion moving in a thrust direction by the thrust force, wherein the contacting/separating motion effected by said contacting/separating member is controlled by said stopper portion.

27. A charging apparatus according to claim 26, wherein a position of said contacting/separating member in a rotation direction is regulated in accordance with a position of said stopper portion in the thrust direction, and the contacting/separating motion effected by said contacting/separating member is controlled in accordance with the position of said contacting/separating member in the rotation direction.

28. A charging apparatus according to claim 25, wherein said thrust generating member is provided by engaging with a gear which is provided on said body to be charged or a gear which is rotated while synchronized with a rotation of said body to be charged.

29. A charging apparatus according to clam 25, further comprising a rotary member engaged with said thrust generating member, wherein the thrust force generated by an inertial force of said rotary member, which is generated when a rotation of said body to be charged is stopped, has a direction opposite to the thrust force, which is generated when the rotation of said body to be charged is started.

30. A charging apparatus according to claim 25, wherein said thrust generating member has a taper shaped portion for generating a thrust force in a first direction when the rotation of said body to be charged is started.

31. A charging apparatus according to claim 30, wherein said thrust generating member includes a second taper shaped portion for generating a thrust force in a second direction opposite to the first direction when the rotation of said body to be charged is stopped.

32. A charging apparatus according to claim 25, wherein said thrust generating member includes one of a twisted polygon hole and a twisted projection to be engaged with the hole.

33. A charging apparatus according to claim 29, wherein an engaging portion between said thrust generating member and said rotary member includes a twisted polygon hole and a twisted projection to be engaged with the hole.

34. A charging apparatus according to claim 25, wherein said thrust generating member is a helical gear.

35. A charging apparatus according to claim 25, wherein said contacting/separating member includes a cam shape.

36. A charging apparatus according to claim 25, wherein said contacting/separating member is a gear in which a portion in a rotation direction of said contacting/separating member is cut away.

37. A charging apparatus according to claim 25, further comprising an elastic member for biasing in a direction opposite to a direction of the thrust force generated when a rotation of said body to be charged is started.

38. A charging apparatus according to claim 26, further comprising an elastic member for biasing in a direction opposite to a direction of the thrust force generated when a rotation of said body to be charged is started, wherein when the rotation of said body to be charged is started, said stopper portion moves in a direction opposite to a direction when the rotation of said body to be charged is stopped.

* * * * *

UNITED STATES PATENT AND TRADEMARK OFFICE

CERTIFICATE OF CORRECTION

PATENT NO. : 6,385,420 B1
DATED : May 7, 2002
INVENTOR(S) : Masanari Morioka

It is certified that error appears in the above-identified patent and that said Letters Patent is hereby corrected as shown below:

Column 1,
Line 28, “onto at” should read -- onto a --;
Line 32, “removed” should read -- removed from --; and
Line 48, “attaching detaching” should read -- attaching/detaching --.

Column 2,
Lines 55 and 66, “another” should be deleted.

Column 6,
Line 31, “which” should read -- which is --; and
Line 62, “flame” should read -- frame --.

Column 8,
Line 6, “cases,” should read -- causes, --;
Line 10, “remain” should read -- remains --;
Line 14, “due” should read -- due to --;
Line 23, “stopped,” should read -- is stopped, --; and
Line 41, “separate” should read -- separates --.

Column 11,
Line 12, “stopped,” should read -- is stopped, --; and
Line 65, “indicates s” should read -- indicates --; and “stopped” should read -- is stopped --.

Column 12,
Line 13, “make” should be deleted; and
Line 50, “force” should read -- forth --; and “an” (first occurrence) should read -- a --.

Column 14,
Line 62, “(or 14)” should read -- (or 140) --.

Column 15,
Line 25, “not shown,” should read -- (not shown) --.

Column 16,
Line 12, “does no” should read -- does not --.

Column 18,
Line 14, “stops” should read -- stop --; and
Line 58, “trust” should read -- thrust --.

UNITED STATES PATENT AND TRADEMARK OFFICE

CERTIFICATE OF CORRECTION

PATENT NO. : 6,385,420 B1
DATED : May 7, 2002
INVENTOR(S) : Masanari Morioka

It is certified that error appears in the above-identified patent and that said Letters Patent is hereby corrected as shown below:

Column 19,
Line 25, “trust” should read -- thrust --.

Signed and Sealed this

Twenty-ninth Day of October, 2002

*Attest:*

*Attesting Officer*

JAMES E. ROGAN
*Director of the United States Patent and Trademark Office*